US012760744B2

(12) United States Patent
Kang et al.

(10) Patent No.: US 12,760,744 B2
(45) Date of Patent: Oct. 13, 2026

(54) CENTRIFUGAL FAN AND HOME APPLIANCE COMPRISING SAME

(71) Applicant: Samsung Electronics Co., Ltd., Suwon-si (KR)

(72) Inventors: Yonghun Kang, Suwon-si (KR); Eunkyeong Kwak, Suwon-si (KR); Ohjin Kwon, Suwon-si (KR); Gihyun Lee, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 19/028,698

(22) Filed: Jan. 17, 2025

(65) Prior Publication Data

US 2025/0305503 A1 Oct. 2, 2025

Related U.S. Application Data

(63) Continuation of application No. PCT/KR2024/021060, filed on Dec. 24, 2024.

(30) Foreign Application Priority Data

Mar. 27, 2024 (KR) ..... 10-2024-0042140
Apr. 12, 2024 (KR) ..... 10-2024-0049680

(51) Int. Cl.
*F04D 29/28* (2006.01)
*F04D 29/44* (2006.01)

(52) U.S. Cl.
CPC ..... *F04D 29/282* (2013.01); *F04D 29/441* (2013.01)

(58) Field of Classification Search
CPC ..... F04D 29/281; F04D 29/424; F04D 17/162
See application file for complete search history.

(56) References Cited

U.S. PATENT DOCUMENTS 6,755,615 B2 * 6/2004 Chapman ..... F04D 29/282 415/206
7,883,312 B2 2/2011 Eguchi et al.
8,915,698 B2 * 12/2014 Jeon ..... F04D 29/162 415/58.4
10,302,096 B2 * 5/2019 Kang ..... F04D 25/08
10,465,696 B2 * 11/2019 Kim ..... F04D 29/30
11,460,039 B2 10/2022 Fournier et al.
(Continued)

FOREIGN PATENT DOCUMENTS

CN 101592166 A 12/2009
ES 2689721 T3 11/2018
(Continued)

OTHER PUBLICATIONS

International Search Report dated Apr. 15, 2025 for PCT/KR2024/021060.
Written Opinion dated Apr. 15, 2025 for PCT/KR2024/021060.

*Primary Examiner* — Justin D Seabe
(74) *Attorney, Agent, or Firm* — Nixon & Vanderhye P.C.

(57) ABSTRACT

A centrifugal fan according to an embodiment includes: a plurality of blades arranged around a rotation axis of the centrifugal fan, and a first shroud and a second shroud located at ends of the plurality of blades. The second shroud surrounds the first shroud and is spaced apart from the first shroud. The second shroud does not overlap the first shroud in a direction parallel to the rotation axis of the centrifugal fan.

20 Claims, 24 Drawing Sheets

(56) References Cited

U.S. PATENT DOCUMENTS

| | | | | |
|---|---|---|---|---|
| 11,592,030 | B2 * | 2/2023 | Kang | F04D 29/281 |
| 11,885,339 | B2 * | 1/2024 | Teramoto | F04D 29/281 |
| 2015/0192143 | A1 * | 7/2015 | Sakai | F04D 29/282<br>415/203 |
| 2019/0128280 | A1 | 5/2019 | Horii et al. | |
| 2019/0290081 | A1 | 9/2019 | Yoshino et al. | |
| 2024/0151409 | A1 | 5/2024 | Inoue et al. | |

FOREIGN PATENT DOCUMENTS

| | | | |
|---|---|---|---|
| JP | 2006-029164 | A | 2/2006 |
| JP | 2006307830 | A | 11/2006 |
| JP | 5051155 | B2 | 8/2012 |
| JP | 2014029149 | A | 2/2014 |
| JP | 2020133525 | A | 8/2020 |
| JP | 2023055364 | A | 4/2023 |
| KR | 2009-0086640 | A | 8/2009 |
| KR | 20230164454 | A | 12/2023 |
| WO | WO 2017179498 | A1 | 10/2017 |

* cited by examiner

CENTRIFUGAL FAN AND HOME APPLIANCE COMPRISING SAME

CROSS-REFERENCE TO RELATED APPLICATIONS

This application is a continuation of International Application No. PCT/KR2024/021060 designating the United States, filed on Dec. 24, 2024, in the Korean Intellectual Property Receiving Office and claiming priority to Korean Patent Application Nos. 10-2024-0042140, filed on Mar. 27, 2024, and 10-2024-0049680, filed on Apr. 12, 2024, in the Korean Intellectual Property Office, the disclosures of each of which are incorporated by reference herein in their entireties.

BACKGROUND

Field

The disclosure relates to a centrifugal fan and a home appliance comprising the same.

Description of Related Art

A home appliance may include a fan for flowing air. The fan may be used for various purposes in various home appliances such as a dryer, an air conditioner, an air purifier, and a range hood. For example, the fan may include a centrifugal fan referred to as a sirocco fan.

The above-described information may be provided as a related art for aiding understanding of the present disclosure. No claim or determination is raised as to whether any of the above-described information may be applied as a prior art related to the present disclosure.

SUMMARY

According to an example embodiment, a centrifugal fan may comprise: a plurality of blades arranged about a rotation axis of the centrifugal fan, a first shroud and a second shroud located at ends of the plurality of blades. The second shroud may surround the first shroud and is spaced apart from the first shroud. The second shroud may not overlap the first shroud in a direction parallel to the rotation axis of the centrifugal fan.

According to an example embodiment, a home appliance may comprise: a centrifugal fan. The centrifugal fan may include: a plurality of blades arranged about a rotation axis of the centrifugal fan, and a first shroud and a second shroud located at ends of the plurality of blades. The second shroud may surround the first shroud and is spaced apart from the first shroud. The second shroud may not overlap the first shroud in a direction parallel to the rotation axis of the centrifugal fan.

BRIEF DESCRIPTION OF THE DRAWINGS

The above and other aspects, features and advantages of certain embodiments of the present disclosure will be more apparent from the following detailed description, taken in conjunction with the accompanying drawings, in which.

DETAILED DESCRIPTION

Figure 1:
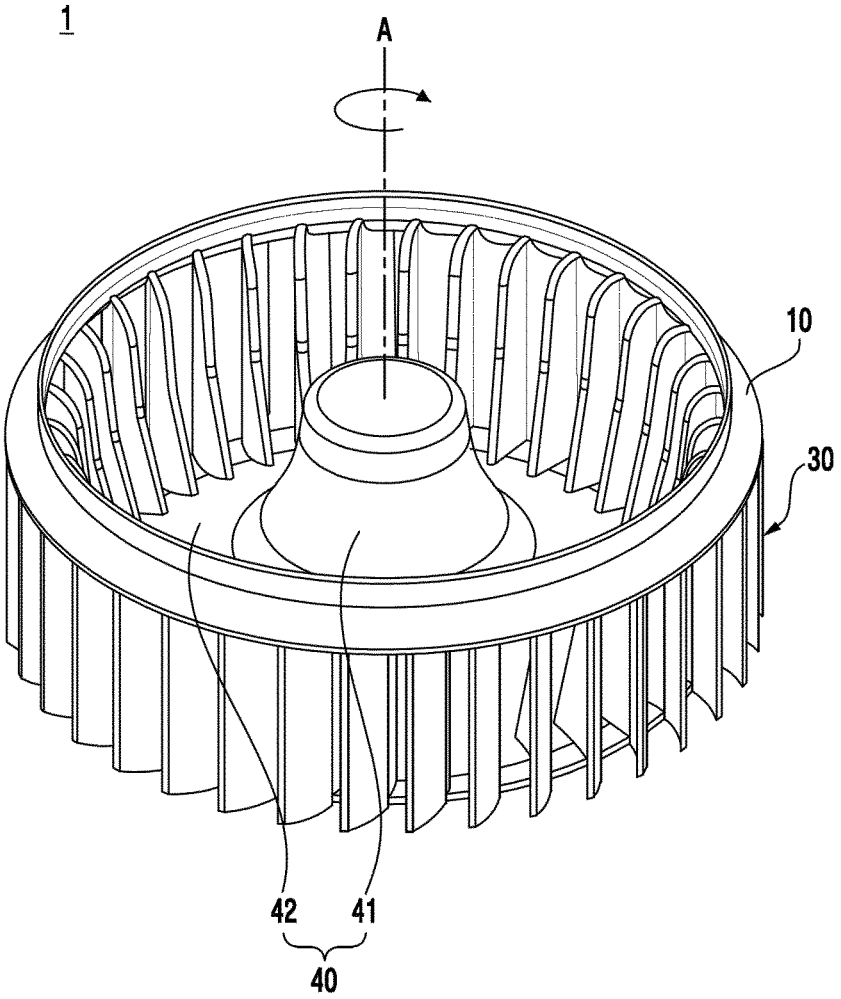
FIG. 1 is a perspective view of a centrifugal fan according to various embodiments.

Terms used in the present disclosure are used to describe various embodiments and are not intended to restrict and/or limit the disclosure. Singular expressions may include plural expressions unless the context clearly indicates otherwise.

In the present disclosure, terms such as "include", "equip", or "have" are intended to specify the presence of a feature, number, step, operation, component, part, or combination thereof described in the disclosure, and do not preclude the possibility of the existence or addition of one or more other features, number, step, operation, component, part, or combinations thereof.

The terms " . . . unit," "module" and the like described in the present disclosure refer to a unit processing at least one function or operation, which may be implemented in hardware or software or a combination of hardware and software.

Hereinafter, various embodiments of the present disclosure will be described in detail with reference to accompanying drawings. However, the present disclosure may be implemented in various forms and is not limited to the various embodiments described herein. In addition, in order to clearly explain the present disclosure in the drawings, portions not related to the description may be omitted. Throughout the present disclosure, the same reference numerals may be provided to denote the same configurations, and redundant descriptions thereof may not be repeated.

Figure 2:
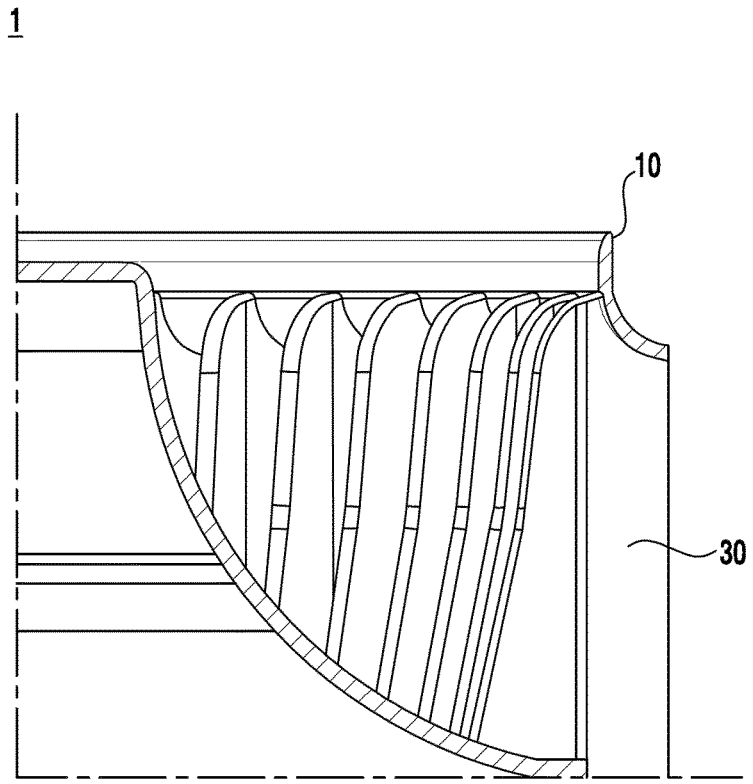
FIG. 2 is a partial cross-sectional view of a centrifugal fan according to various embodiments.

FIG. 1 is a perspective view of a centrifugal fan according to various embodiments. FIG. 2 is a partial cross-sectional view of a centrifugal fan according to various embodiments.

Referring to FIGS. 1 and 2, a centrifugal fan 1 according to an embodiment may include a shroud 10, a plurality of blades 30, and a hub plate 40. The centrifugal fan 1 may be referred to as a sirocco fan or a multi-blade fan.

The hub plate 40 may include a hub 41 to which a plate 42 supporting the plurality of blades 30 and a shaft of a motor for rotating the centrifugal fan 1 are coupled. The hub 41 may protrude from the plate 42 into the inside of the centrifugal fan 1.

The plurality of blades 30 may be positioned between the shroud 10 and the plate 42. The plurality of blades 30 may be arranged around (e.g., about) a rotation axis A. The plurality of blades 30 may be spaced apart from each other. The plurality of blades 30 may extend in a direction parallel to the rotation axis A. Like a forward curved fan, the plurality of blades 30 may be bent forward based on a rotation direction of the centrifugal fan 1.

The shroud 10 may be positioned on ends of the plurality of blades 30. The shroud 10 may improve durability (e.g., rigidity) of the centrifugal fan 1 by supporting the blades 30 rotating at high speed. The shroud 10 may have a circular shape centered on the rotation axis A. The shroud 10 may include an inner surface coupled to the plurality of blades 30 and an outer surface opposite to the inner surface. The outer surface of the shroud 10 may have a cross-sectional shape entirely bent toward the plurality of blades 30 (or the rotation axis A). The inner surface of the shroud 10 may have a cross-sectional shape entirely bent toward the plurality of blades 30 (or the rotation axis A). Herein, the cross-sectional shape being "entirely" bent toward the plurality of blades 30 may refer, for example, to the cross-sectional shape being formed solely by one or more curved sections bent toward the plurality of blades 30, or that the cross-sectional shape may be formed by one or more flat sections together with the one or more curved sections.

The shroud 10, the plurality of blades 30, and the hub plate 40 may be integrally formed. For example, the centrifugal fan 1 may be manufactured by an injection molding process in which an moldable material (e.g., molten plastic) is injected into a mold, cured, and then the cured moldable material is removed from the mold. In this case, in order to reduce a cost of the manufacturing process and improve the efficiency, the centrifugal fan 1 may include a structure capable of top and bottom separation of a mold. For example, the shroud 10 may not include an undercut shape.

Figure 9:
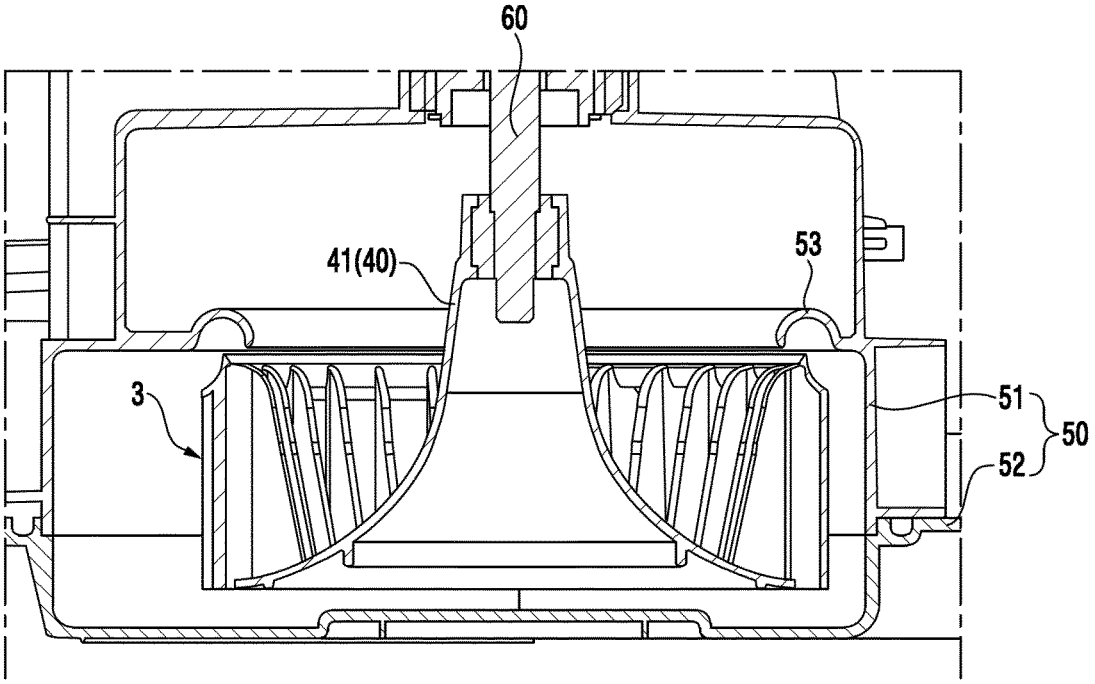
FIG. 9 is a cross-sectional view illustrating a fan inside a casing according to various embodiments.

The centrifugal fan 1 may be accommodated within a casing (not shown) (e.g., a casing 50 of FIG. 9). The centrifugal fan 1 may generate a pressure change by rotating around a rotation axis A in the inside of the casing by a rotation of the motor. Due to the pressure change, air may be sucked into the centrifugal fan 1 through the shroud 10. The sucked air may flow along a wall surface of the casing by a centrifugal force in a direction perpendicular to the rotation axis A of the centrifugal fan 1, and may be discharged through a discharge hole provided in the casing. At this time, a phenomenon may occur in which the flow at a rear end of the centrifugal fan 1 may not exit through the discharge hole, and may be introduced back into the centrifugal fan 1. The reintroduced air may cause noise due to collision with the newly introduced air. Accordingly, the efficiency of the centrifugal fan 1 may be reduced. The shroud 10 of the centrifugal fan 1 may disperse a flow rate of the above-described introduction air by forming a self-contained air flow path (or an independent air flow path) of the centrifugal fan 1. Accordingly, the efficiency of the centrifugal fan 1 may be increased and noise may be reduced. These will be described in greater detail below with reference to FIGS. 12A to 13F.

Figure 3:
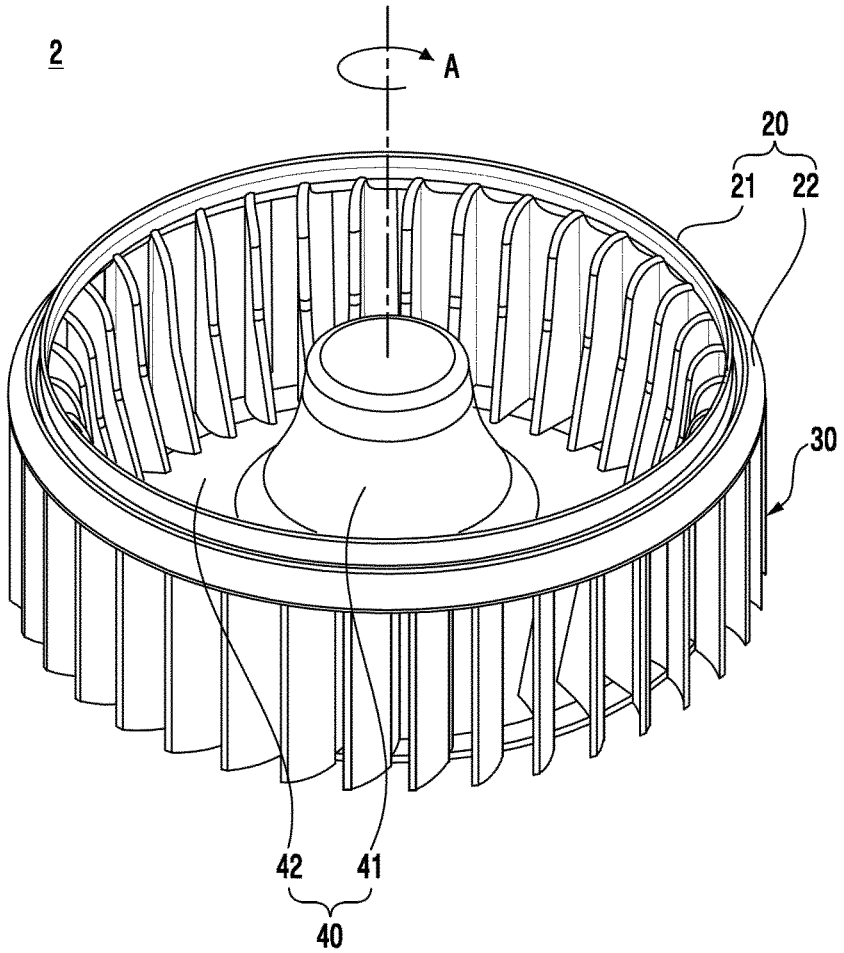
FIG. 3 is a perspective view of a centrifugal fan according to various embodiments.
Figure 4:
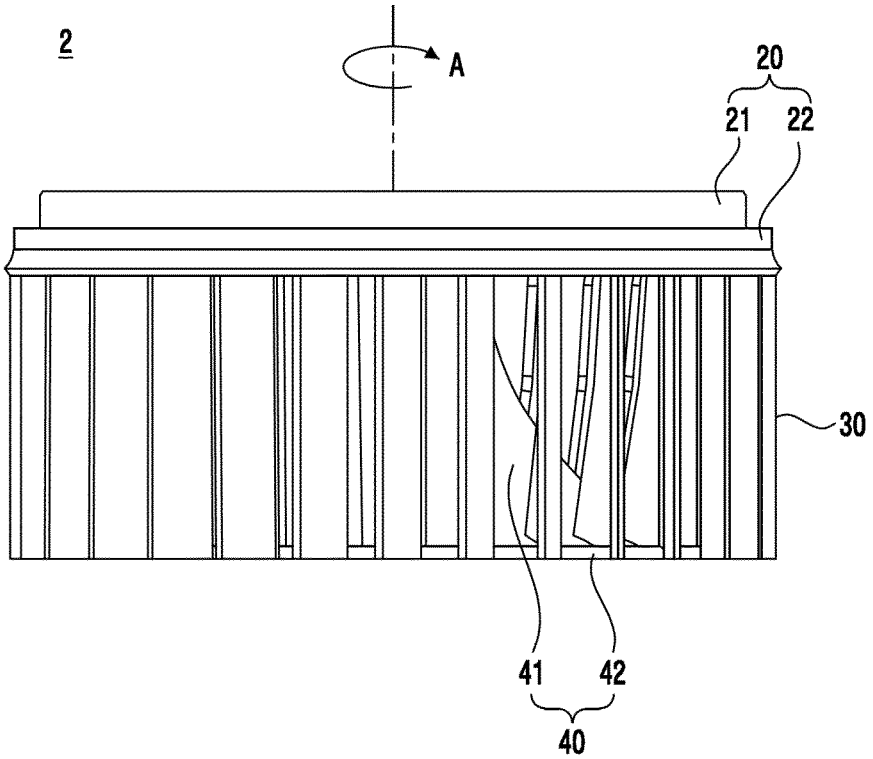
FIG. 4 is a diagram illustrating a side view of a centrifugal fan according to various embodiments.
Figure 5:
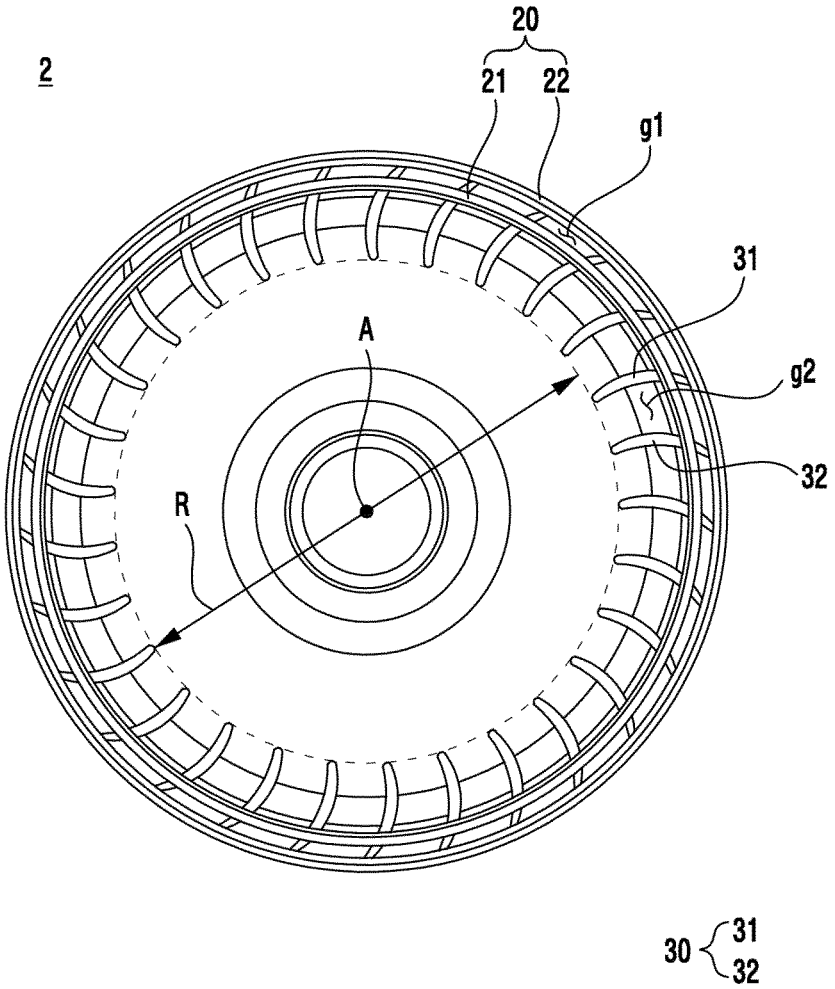
FIG. 5 is a diagram illustrating a top view of a centrifugal fan according to various embodiments.
Figure 6:
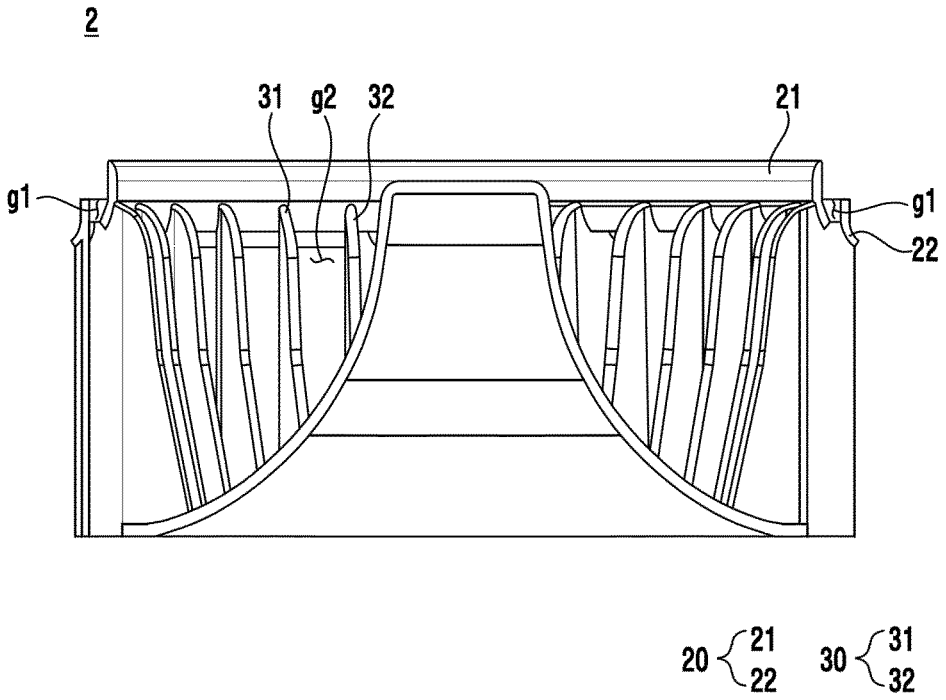
FIG. 6 is a cross-sectional view of a centrifugal fan according to various embodiments.
Figure 7:
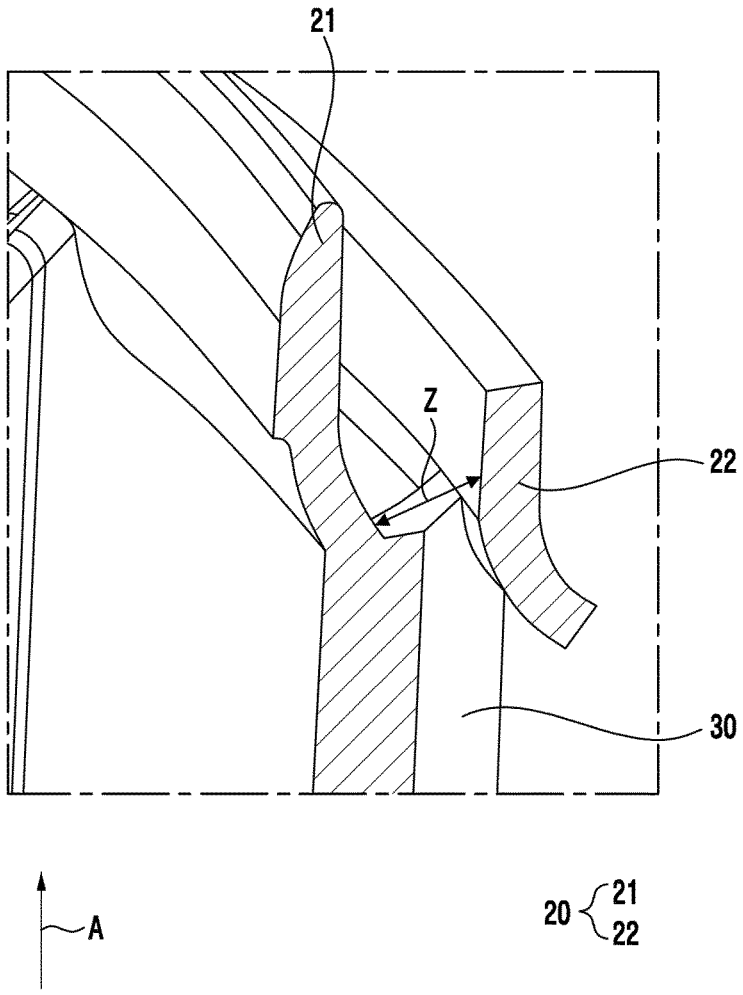
FIG. 7 is a partial cross-sectional perspective view of a centrifugal fan according to various embodiments.

FIG. 3 is a perspective view of a centrifugal fan according to various embodiments. FIG. 4 is a diagram illustrating a side view of a centrifugal fan according to various embodiments. FIG. 5 is a diagram illustrating a top view of a centrifugal fan according to various embodiments. FIG. 6 is a cross-sectional view of a centrifugal fan according to various embodiments. FIG. 7 is a partial cross-sectional perspective view of a centrifugal fan according to various embodiments.

Referring to FIGS. 3 and 4, a centrifugal fan 2 according to an embodiment may include a shroud 20, a plurality of blades 30, and a hub plate 40.

The plurality of blades 30 may be positioned between the shroud 20 and the plate 42. The shroud 20 may be coupled to ends of the plurality of blades 30. The shroud 20 may improve durability (e.g., rigidity) of the centrifugal fan 2 by supporting the blades 30 rotating at a high speed.

The shroud 20 may include a first shroud 21 and a second shroud 22, which are positioned on ends of the plurality of blades 30. The first shroud 21 and the second shroud 22 may have a circular shape centered on a rotation axis A. A diameter of the first shroud 21 may be smaller than a diameter of the second shroud 22. The second shroud 22 may surround the first shroud 21. The second shroud 22 may be spaced apart from the first shroud 21.

Referring to FIG. 5, the first shroud 21 and the second shroud 22 may be arranged to be biased outside the plurality of blades 30. For example, the plurality of blades 30 may define an inner diameter R and an outer diameter (not illustrated) centered on the rotation axis A. The first shroud 21 and the second shroud 22 may be closer to the outer diameter than the inner diameter R.

Referring to FIGS. 5 and 6, the first shroud 21 and the second shroud 22 may be separated through a gap g1. Each of the plurality of blades 30 may be spaced apart from each other, and a gap between them may be directly connected to the gap g1 between the first shroud 21 and the second shroud 22. For example, the first blade 31 and the second blade 32 may be separated through a gap g2. The gap g2 between the first blade 31 and the second blade 32 may be directly connected to the gap g1 between the first shroud 21 and the second shroud 22.

Referring to FIG. 7, the first shroud 21 may include an inner surface coupled to the plurality of blades 30, and an outer surface opposite to the inner surface and facing the second shroud 22. The outer surface of the first shroud 21 may have a cross-sectional shape entirely bent toward the plurality of blades 30 (or a center of the centrifugal fan 2). The inner surface of the first shroud 21 may have a cross-sectional shape entirely bent toward the plurality of blades 30 (or the center of the centrifugal fan 2). The outer surface of the second shroud 22 may have a cross-sectional shape entirely bent toward the plurality of blades 30 (or the center of the centrifugal fan 2). The inner surface of the second shroud 22 may have a cross-sectional shape entirely bent toward the plurality of blades 30 (or the center of the centrifugal fan 2). The first shroud 21 may at least partially overlap the second shroud 22 based on a direction perpendicular to the rotation axis A, but the disclosure is not limited thereto.

The shroud 20, the plurality of blades 30, and the hub plate 40 may be integrally formed. For example, the centrifugal fan 2 may be manufactured by an injection molding process in which an moldable material (e.g., molten plastic) is injected into a mold, cured, and then the cured moldable material is removed from the mold. In this case, in order to reduce a cost of the manufacturing process and improve the efficiency, the centrifugal fan 2 may include a structure capable of top and bottom separation of a mold. For example, the first shroud 21 and the second shroud 22 may not include an undercut shape. For example, the first shroud 21 and the second shroud 22 may not overlap based on a direction parallel to the rotation axis A. For example, the first shroud 21 and the second shroud 22 may be spaced apart by a distance Z, when viewed in a direction parallel to the rotation axis A. The distance Z may be a length between the first shroud 21 and the second shroud 22 based on the direction perpendicular to the rotation axis A. Accordingly, top and bottom separation of the mold may be possible based on a direction parallel to the rotation axis A. As a non-limiting example, the distance Z may be less than or equal to 2% of the total width (e.g., outer diameter) of the centrifugal fan 2. As a non-limiting example, the distance Z may be greater than 0 and less than or equal to 2% of the total width of the centrifugal fan 2. As a non-limiting example, the distance Z may be greater than or equal to 2 mm and less than or equal to 5. As a non-limiting example, the distance Z may be greater than or equal to 0.5 mm and less than or equal to 2.5 mm. As a non-limiting example, when the total width of the centrifugal fan 2 is about 150 mm, the distance Z may be greater than or equal to 0.5 mm and less than or equal to 2.5 mm. As a non-limiting example, a ratio (e.g., distance Z/total width) of the distance (Z) and the total width of the centrifugal fan 2 may be greater than or equal to about 0.0033 and less than or equal to 0.0167. A flow rate Q and torque energy (TQE) of the centrifugal fan 2 according to the distance Z at the entire 1900 rotations per minute (RPM) of the centrifugal fan 2 are illustrated in Table 1 below. The torque energy (TQE) is a value indicating a load of a motor connected to the centrifugal fan 2, and it may indicate that power consumption of the motor lowers as the torque energy (TQE) lowers.

TABLE 1

| 1900 RPM | Z = 0.5 mm | Z = 2.5 mm | Remarks |
|---|---|---|---|
| Q [$m^3$/minute] | 2.8937 | 2.8932 | Equivalent |
| TQE [Nm] | 0.1322 | 0.1309 | Approximately 1% reduction |

Referring back to FIG. 3, the centrifugal fan 2 may be accommodated in a casing (not illustrated) (e.g., the casing 50 of FIG. 9). The centrifugal fan 2 may generate a pressure change by rotating around the rotation axis A inside the casing by a rotation of the motor. Due to the pressure change, air may be sucked into the centrifugal fan 2 through the shroud 20. The sucked air may flow along a wall surface of the casing by a centrifugal force in a direction perpendicular to the rotation axis A of the centrifugal fan 2, and may be discharged through a discharge hole provided in the casing. At this time, a phenomenon may occur in which the flow at a rear end of the centrifugal fan 2 may not exit through the discharge hole, and may be introduced back into the centrifugal fan 2. The reintroduced air may cause noise due to collision with the newly introduced air. Accordingly, the efficiency of the centrifugal fan 2 may be reduced. The shroud 20 of the centrifugal fan 2 may disperse a flow rate of the above-described introduction air by forming a self-contained air flow (or an independent air flow path) of the centrifugal fan 2. Accordingly, the efficiency of the centrifugal fan 2 may be increased and noise may be reduced. These will be described in greater detail below with reference to FIGS. 12A to 13F.

Figure 8:
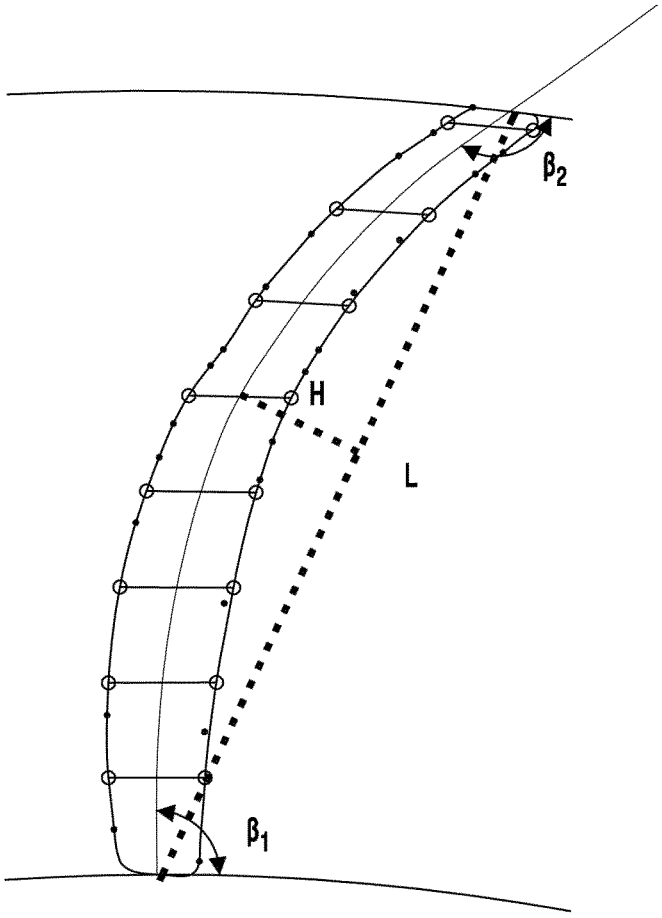
FIG. 8 is a cross-sectional view of a blade of a centrifugal fan according to various embodiments.

FIG. 8 is a cross-sectional view of a blade of a centrifugal fan according to various embodiments.

Referring to FIG. 8, a chord length L connecting a center of a leading edge and a center of a trailing edge of a blade (e.g., a plurality of blades 30), a height H at which the blade is bent to the maximum, a flow inlet angle β1 at a center of the blade, and an exit angle β2 discharged from a rear end of the blade may be defined. The height H may be a distance from the chord length L to a center point of a portion where a degree of bending of the blade is maximum. The flow inlet angle β1 may be greater than or equal to 95 degrees and less than or equal to 105 degrees. The exit angle β2 may be greater than or equal to 140 degrees and less than or equal to 150. A ratio (e.g., height H/chord length L) of the height H and the chord length L may be greater than or equal to 0.17 and less than or equal to 0.2. A ratio (e.g., inner diameter R/chord length L) of an inner diameter (e.g., the inner diameter R in FIG. 5) of a blade and the chord length L may be greater than or equal to 2.5 and less than or equal to 3.

FIG. 9 is a cross-sectional view illustrating a fan inside a casing according to various embodiments.

Referring to FIG. 9, a centrifugal fan 3 (e.g., the centrifugal fan 1 of FIG. 1 or the centrifugal fan 2 of FIG. 3) may be disposed inside a casing 50. The casing 50 may include an upper casing 51 and a lower casing 52 coupled to a lower portion of the upper casing 51. The upper casing 51 and the lower casing 52 may accommodate the centrifugal fan 3 together. The upper casing 51 may define a bell mouth 53 through which air is introduced into the inside of the centrifugal fan 3. Although not illustrated, the casing 50 may define a discharge hole. A shaft 60 of a motor may be coupled to the hub 41 of the hub plate 40 to rotate the centrifugal fan 3. By the rotation of the centrifugal fan 3, air may be sucked into the centrifugal fan 3 through the bell mouse 53. The sucked air may be discharged through the discharge hole formed in the casing 50, by the centrifugal force according to the rotation of the centrifugal fan 3.

Figure 10:
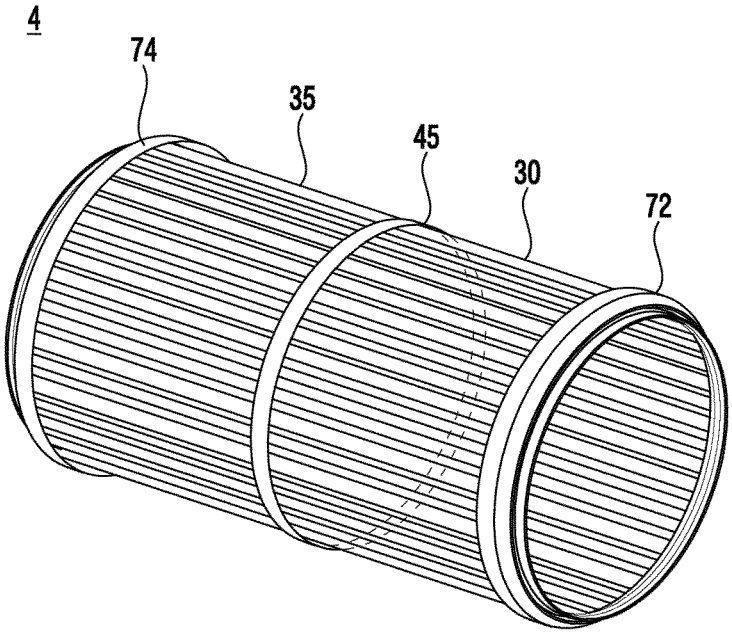
FIG. 10 is a perspective view illustrating a centrifugal fan according to various embodiments.

FIG. 10 is a perspective view illustrating a centrifugal fan according to various embodiments.

Referring to FIG. 10, unlike the centrifugal fan 1 and the centrifugal fan 2 being configured in a one-way suction method, a centrifugal fan 4 may be capable of sucking in both directions. For example, the centrifugal fan 4 may include a hub plate 45 (e.g., the hub plate 40), a plurality of blades 30 disposed on a side of the hub plate 45, a shroud structure 72 (e.g., shroud 10 or 20) disposed at ends of the plurality of blades 30, a plurality of blades 35 disposed at another side of the hub plate 45, and a shroud structure 74 (e.g., shroud 10 or 20) disposed at ends of the plurality of blades 35. By rotation of the centrifugal fan 4, air may be introduced by passing through the inside of the shroud structure 72 and of the shroud structure 74. The description provided with reference to the plurality of blades 30 may be applied to the plurality of blades 35 in substantially the same or corresponding manner.

Figure 11A:
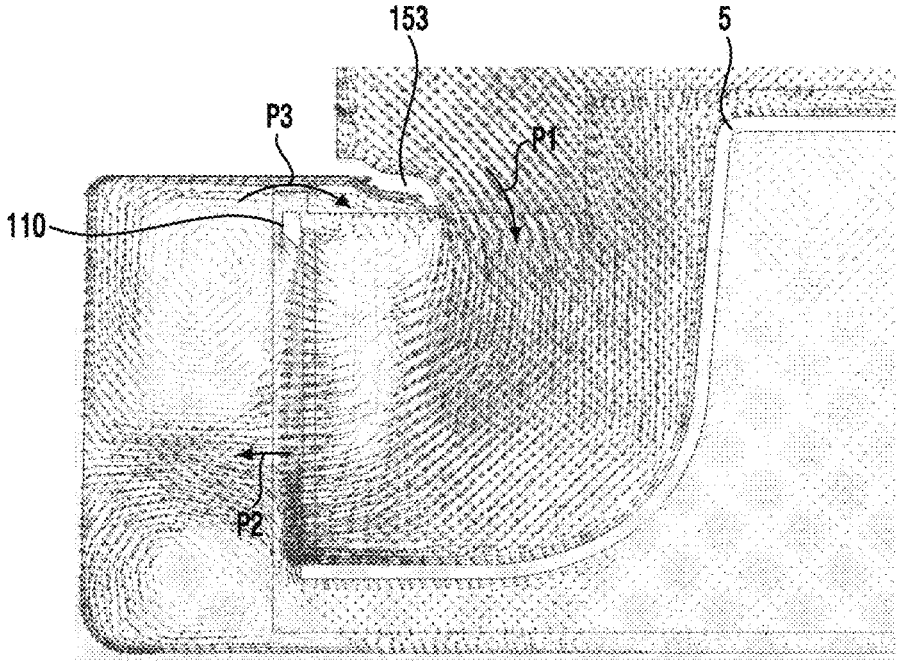
FIG. 11A is a diagram illustrating flow distribution of a centrifugal fan according to a comparative example.
Figure 11B:
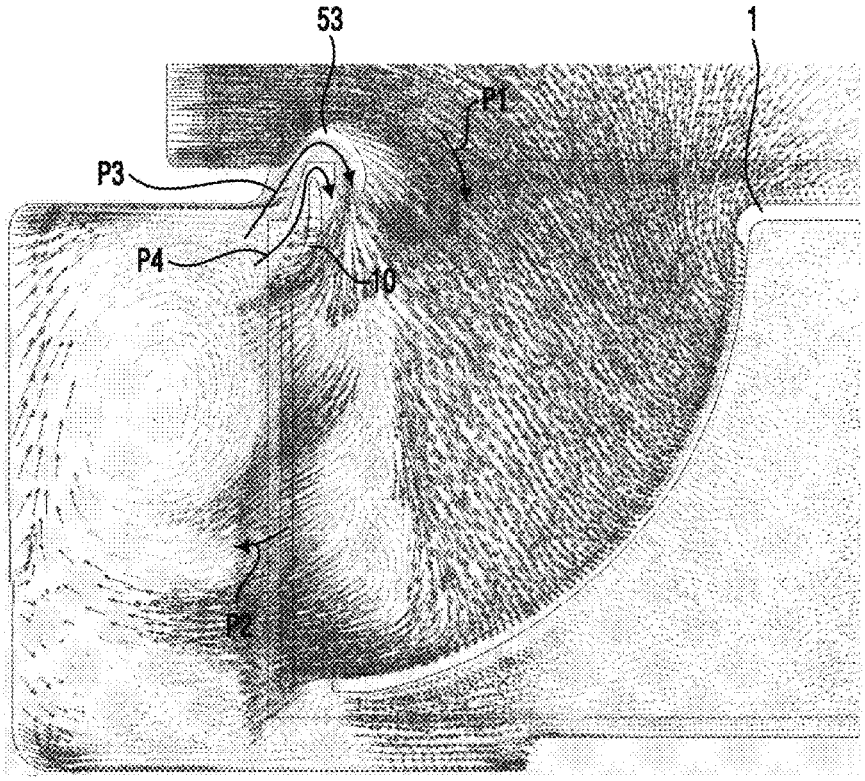
FIG. 11B is a diagram illustrating flow distribution of a centrifugal fan according to various embodiments.
Figure 11C:
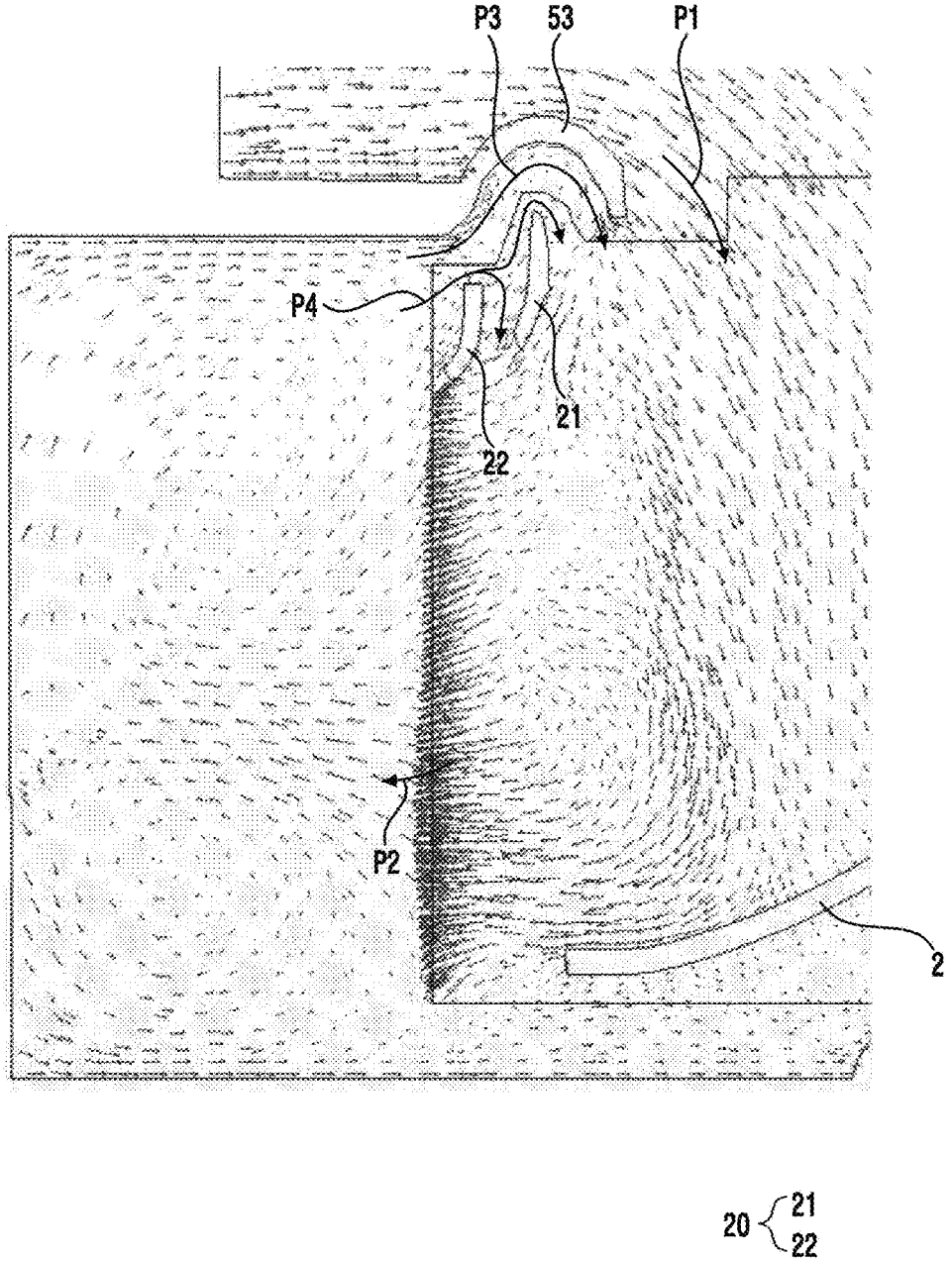
FIG. 11C is a diagram illustrating flow distribution of a centrifugal fan according to various embodiments.

FIG. 11A is a diagram illustrating flow distribution of a centrifugal fan according to a comparative example. FIGS. 11B and 11C are diagrams illustrating flow distribution of a centrifugal fan according to various embodiments. FIG. 11B may illustrate flow distribution of the centrifugal fan 1 including the shroud 10. FIG. 11C may illustrate flow distribution of the centrifugal fan 2 including the shroud 20. FIG. 11A may illustrate flow distribution of a centrifugal fan 5 including a ring-shaped member 110 other than the shroud 10 and the shroud 20, according to a comparative example. A direction of arrows illustrated in FIGS. 11A, 11B, and 11C may indicate a direction in which air flows.

Referring to FIG. 11A, a cross-section of the member 110 of the centrifugal fan 5 in the comparative example may be formed in a flat surface, unlike the shroud 10 and the shroud 20. As the centrifugal fan 5 rotates, air may be introduced along a path P1 passing through a bell mouse 153. The introduced air may be discharged along a path P2 in a lateral direction (e.g., a direction perpendicular to a rotational axis of the centrifugal fan 5) of the centrifugal fan 5. In this time, the discharged air may be reintroduced into the centrifugal fan 5 along a path P3. The air reintroduced along the path P3 may collide with air newly introduced along the path P1. Accordingly, noise generated by the centrifugal fan 5 may be increased, and efficiency of the centrifugal fan 5 may be lowered. A fan used in a home appliance (e.g., a dryer 140 of FIG. 14) may require high-speed rotation due to internal resistance of an air flow system, but high efficiency may be required according to quietness and energy efficiency regulations.

Referring to FIG. 11B, according to an embodiment, the centrifugal fan 1 including the shroud 10 may form a self-contained air flow path (or an independent air flow path) like a path P4. Due to a flow rate of air along the path P4, a flow rate of air along the path P3 may be dispersed. Accordingly, collision between the air introduced through the path P1 and the air reintroduced through the path P3 may be reduced. As a result, noise generated by the centrifugal fan 1 may be reduced compared to the centrifugal fan 5 of the comparative example. In addition, the efficiency of the centrifugal pen 1 may be improved than that of the centrifugal fan 5 of the comparative example.

Referring to FIG. 11C, the centrifugal fan 2 including the shroud 20 may form a self-contained air flow path (or an independent air flow path) like the path P4. Due to the flow rate of air along the path P4, the flow rate of air along the path P3 may be dispersed. Accordingly, the collision between the air introduced through the path P1 and the air reintroduced through the path P3 may be reduced. As a result, noise generated by the centrifugal fan 2 may be reduced compared to the centrifugal fan 5 of the comparative example. In addition, the efficiency of the centrifugal pen 2 may be improved than that of the centrifugal fan 5 of the comparative example. The effect of dispersing the air reintroduced through the path P3 due to the air flow along the path P4 may be greater in the centrifugal fan 2 than in the centrifugal fan 1. That is, the centrifugal fan 2 may have lower noise and higher efficiency than the centrifugal fan 1.

Figure 12A:
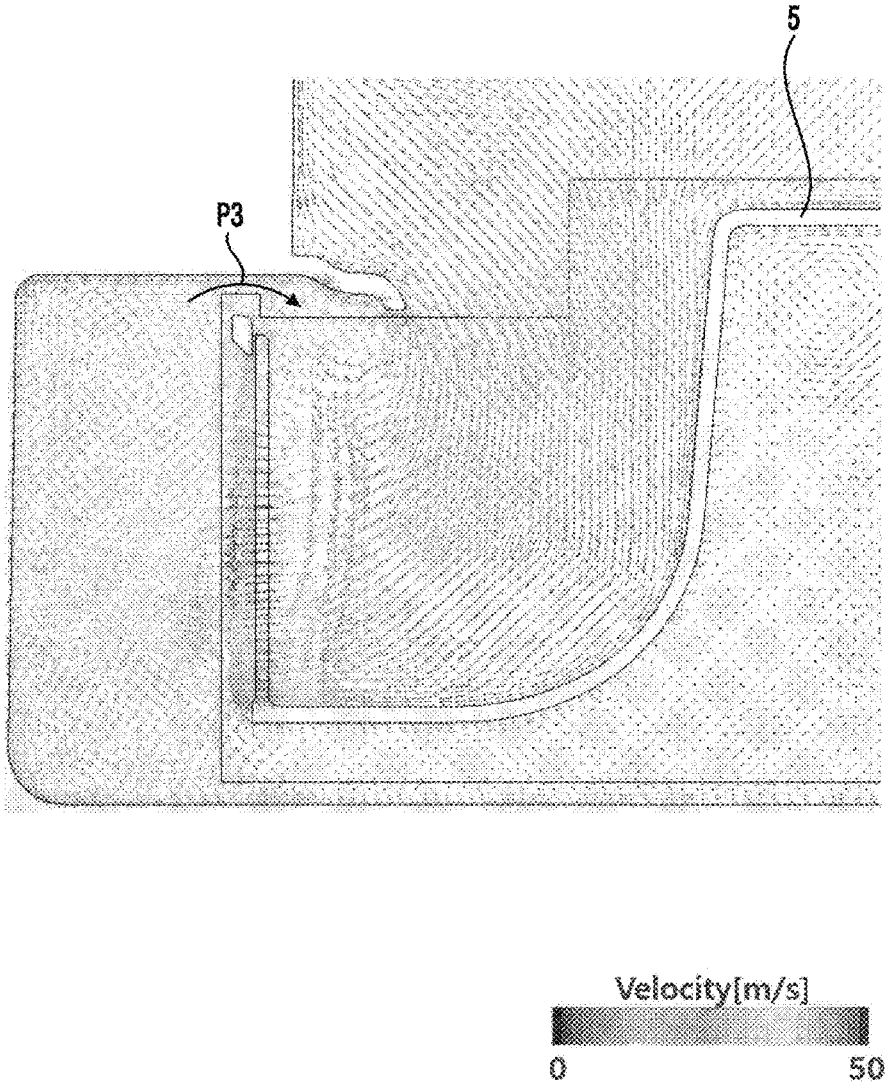
FIG. 12A is a diagram illustrating flow distribution of a centrifugal fan according to a comparative example.
Figure 12B:
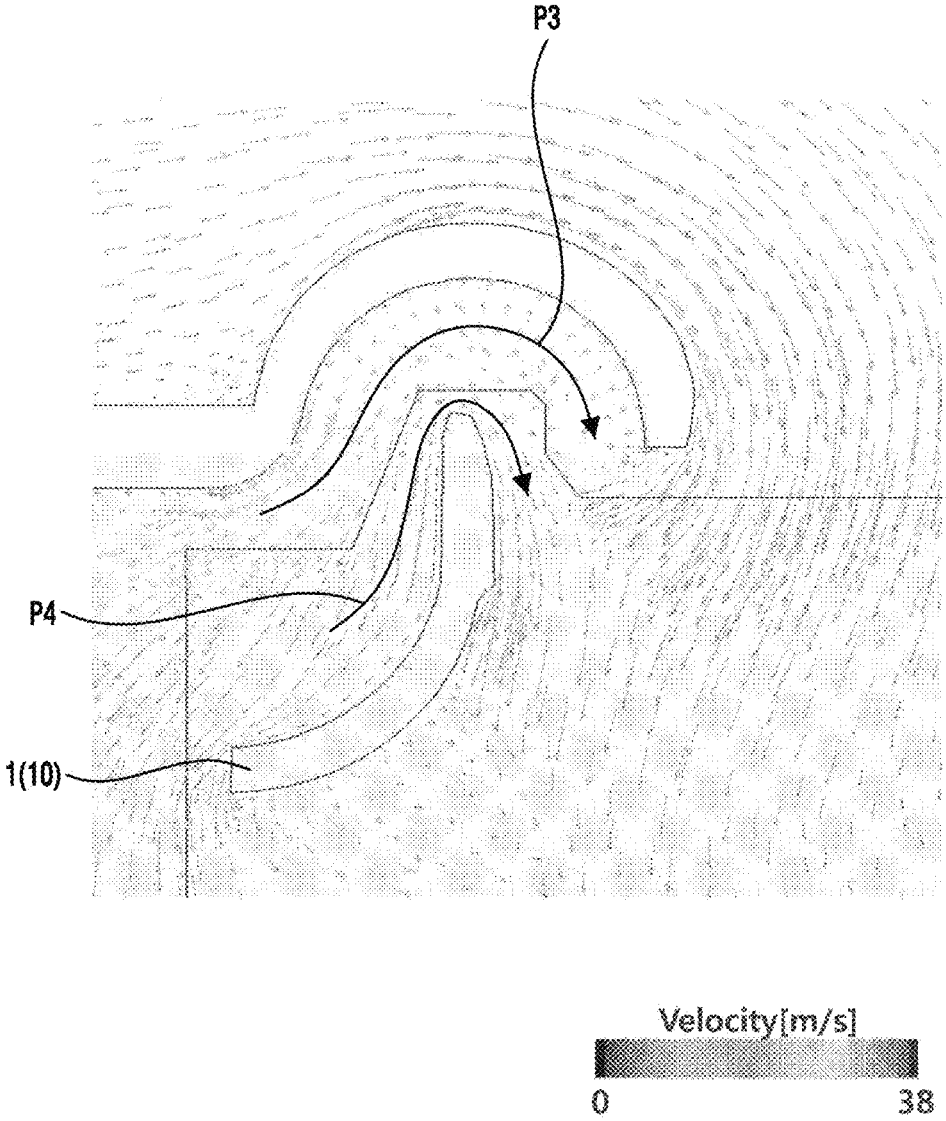
FIG. 12B is a diagram illustrating flow distribution of a centrifugal fan according to various embodiments.
Figure 12C:
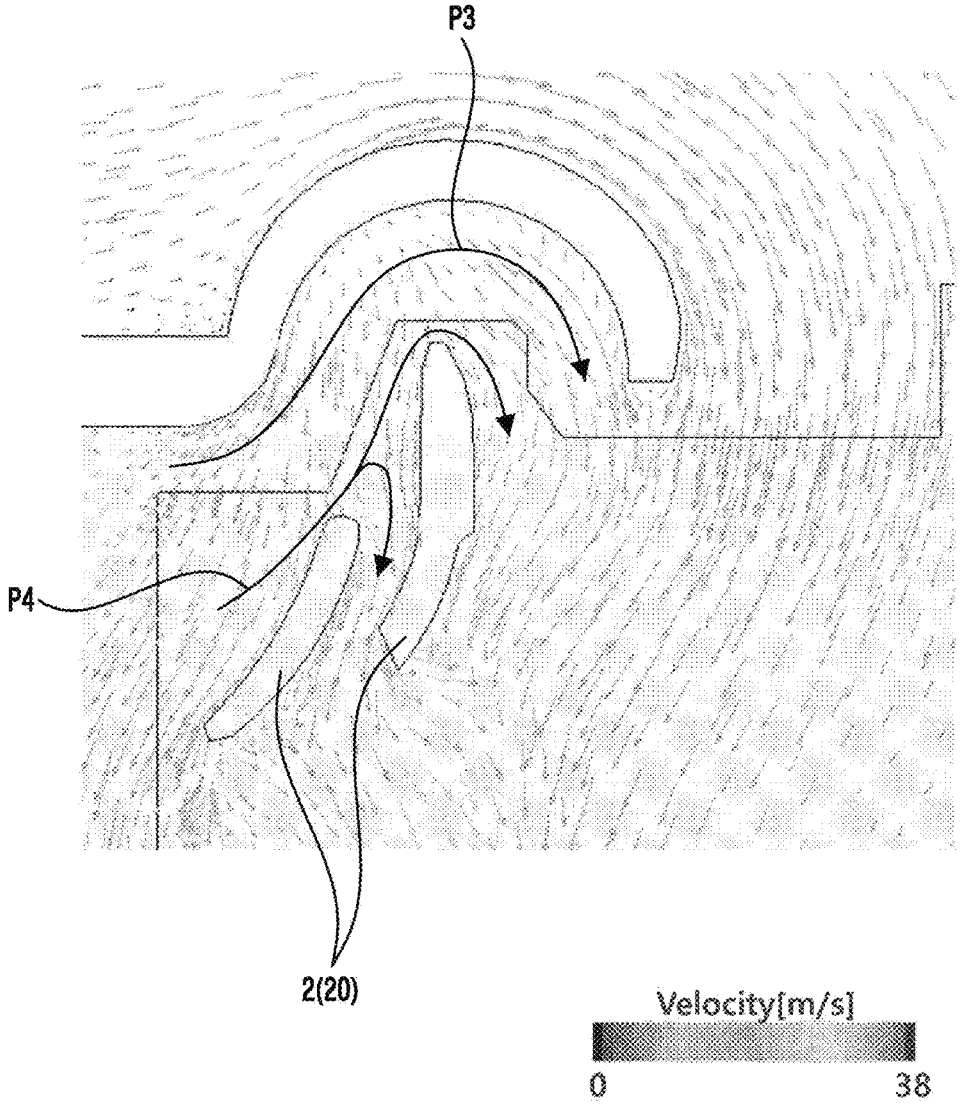
FIG. 12C is a diagram illustrating flow distribution of a centrifugal fan according to various embodiments.

FIG. 12A is a diagram illustrating flow distribution of a centrifugal fan according to a comparative example. FIGS. 12B and 12C are diagrams illustrating flow distribution of a centrifugal fan according to various embodiments. FIG. 12B may illustrate flow distribution of the centrifugal fan 1 including the shroud 10. FIG. 12C may illustrate flow distribution of the centrifugal fan 2 including the shroud 20. FIG. 12A may illustrate flow distribution of the centrifugal fan 5 including a ring-shaped member 110 other than the shroud 10 and the shroud 20 according to a comparative example. Shades of arrows illustrated in FIGS. 12A, 12B, and 12C may indicate velocities through which air flows.

Referring to FIGS. 12A and 12B, a velocity of air flowing along the path P3 of the centrifugal fan 1 according to an embodiment may be less than a velocity of air flowing along the path P3 of the centrifugal fan 5 according to a comparative example. This may indicate that the centrifugal fan 1 according to an embodiment may have lower noise and higher efficiency than the centrifugal fan 5 of the comparative example. This may be because the air flow along the path P3 is dispersed as the shroud 10 of the centrifugal fan 1 forms an air flow path along the path P4.

Referring to FIGS. 12A and 12B, a velocity of air flowing along the path P3 of the centrifugal fan 2 according to an embodiment may be less than a velocity of air flowing along the path P3 of the centrifugal fan 5 according to the comparative example. This may indicate that the centrifugal fan 2 according to an embodiment may have lower noise and higher efficiency than the centrifugal fan 5 of the comparative example. This may be because the air flow along the path P3 is dispersed as the shroud 20 of the centrifugal fan 2 forms an air flow path corresponding to the path P4.

Referring to FIGS. 12B and 12C, a velocity of air flowing along the path P3 of the centrifugal fan 2 according to an embodiment may be less than a velocity of air flowing along the path P3 of the centrifugal fan 1. This may be because a flow rate (e.g., a flow rate according to the path P4 of FIG. 12C) through the shroud 20 of the centrifugal fan 2 is greater than a flow rate (e.g., a flow rate according to the path P4 of FIG. 12B) through the shroud 10 of the centrifugal fan 1. This may indicate that the centrifugal fan 2 according to an embodiment may have lower noise and higher efficiency than the centrifugal fan 1.

Figure 13A:
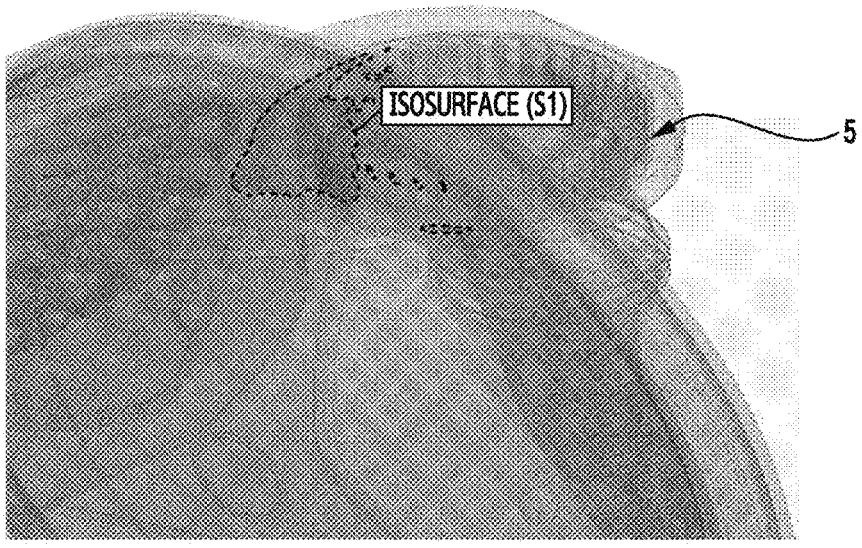
FIG. 13A is a diagram illustrating an isosurface of a centrifugal fan according to a comparative example.
Figure 13B:
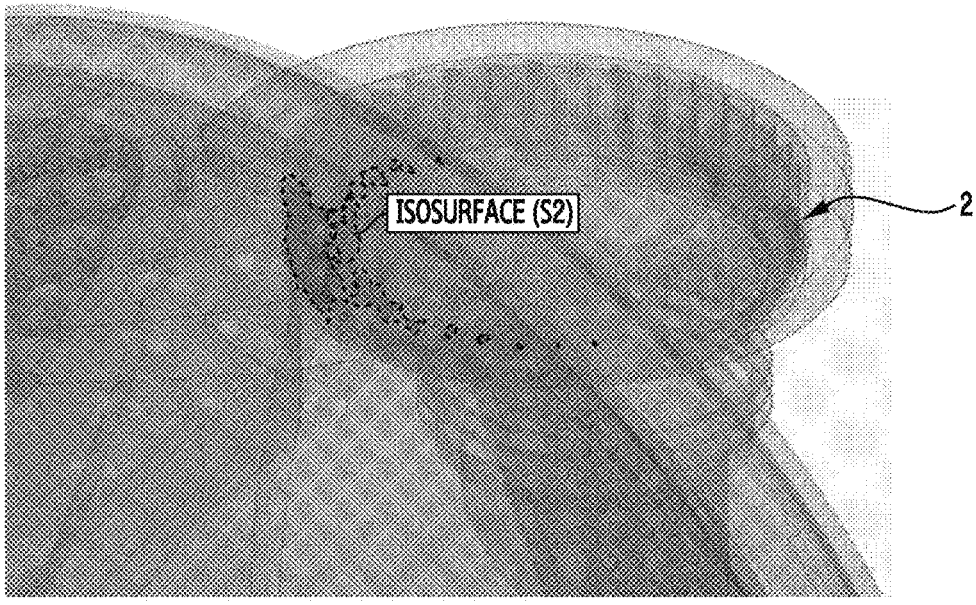
FIG. 13B is a diagram illustrating an isosurface of a centrifugal fan according to various embodiments.

FIG. 13A is a diagram illustrating an isosurface of a centrifugal fan according to a comparative example. FIG. 13B is a diagram illustrating an isosurface of a centrifugal fan according to various embodiments. An isosurface S1 of the centrifugal fan 5 according to the comparative example illustrated in FIG. 13A may indicate a region having turbulence kinetic energy (TKE) greater than or equal to 30 KJ/kg. An isosurface S2 of the centrifugal fan 2 according to the embodiment illustrated in FIG. 13B may indicate a region having turbulence kinetic energy greater than or equal to 30 KJ/kg.

Referring to FIGS. 13A and 13B, an area of the isosurface S2 of the centrifugal fan 2 according to various embodiments may be smaller than an area of the isosurface S1 of the centrifugal fan 5 according to the comparative example. Accordingly, the centrifugal fan 2 may reduce noise generated by turbulence flow and efficiency loss due to turbulence flow, compared to the centrifugal fan 5 of the comparative example. For example, the centrifugal fan 2 may have lower noise and higher efficiency than the centrifugal fan 5 of the comparative example.

Figure 13C:
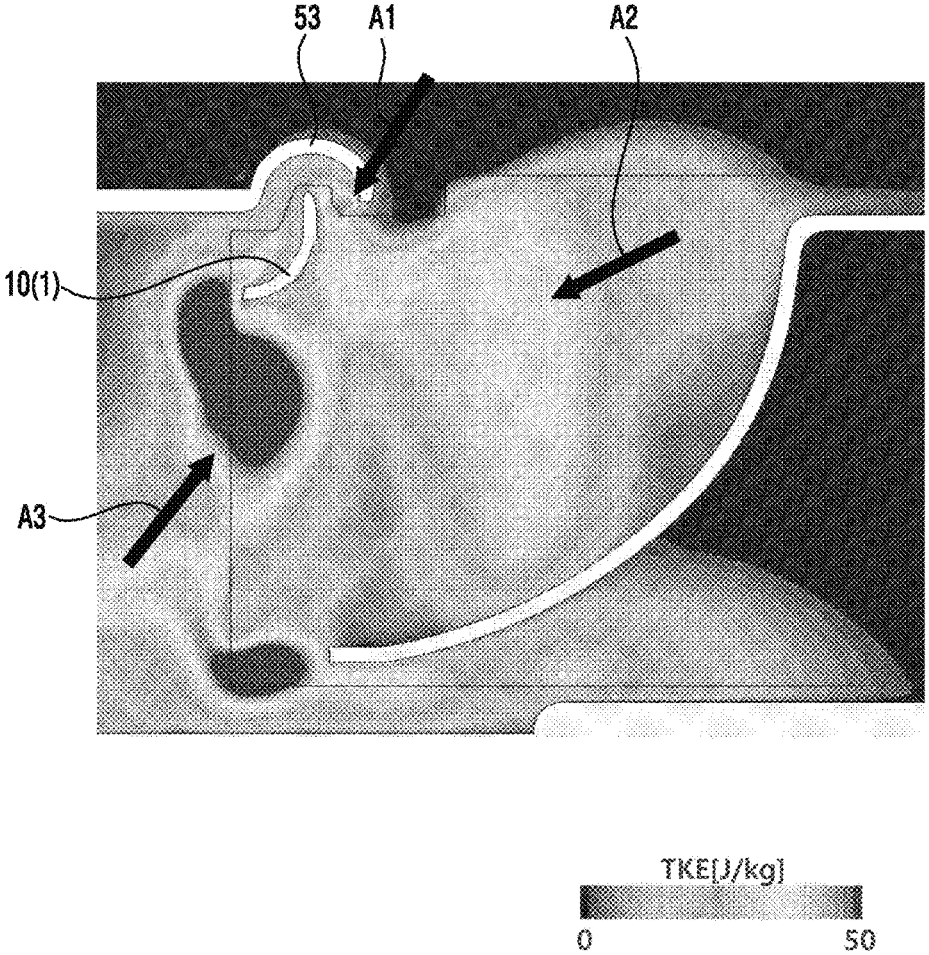
FIG. 13C is a diagram illustrating turbulence kinetic energy of a centrifugal fan according to various embodiments.
Figure 13D:
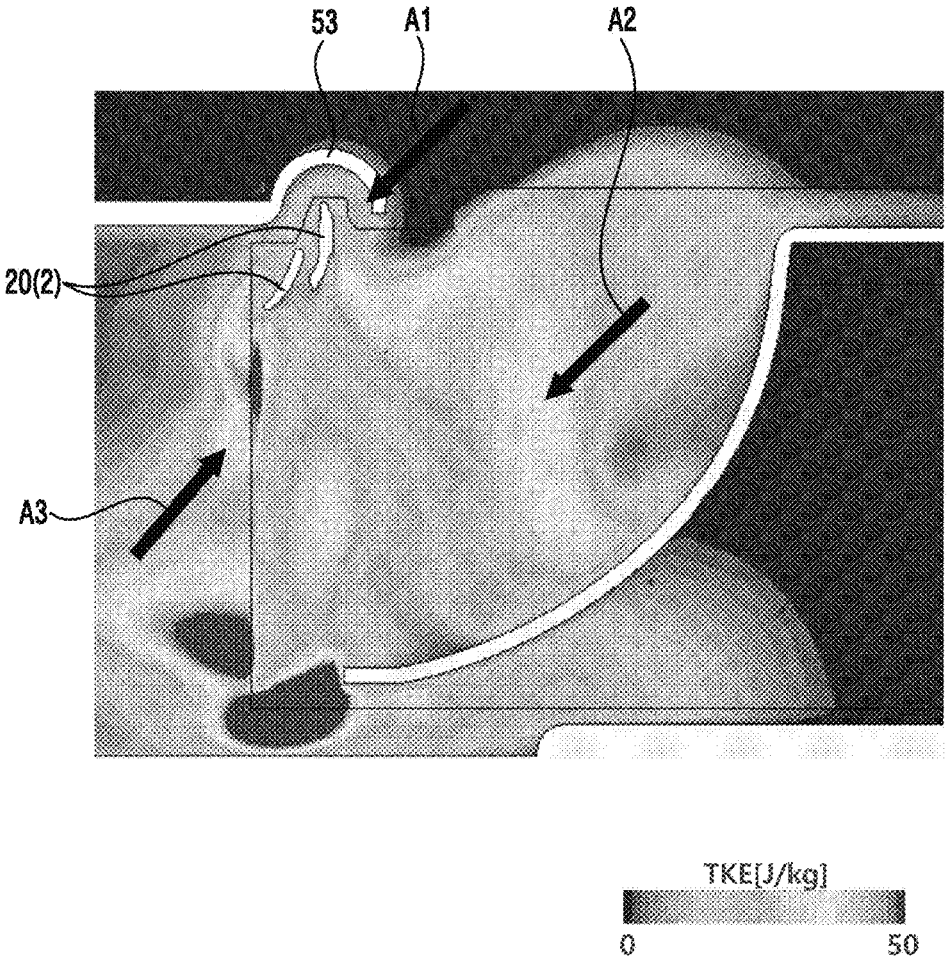
FIG. 13D is a diagram illustrating turbulence kinetic energy of a centrifugal fan according to various embodiments.

FIG. 13C is a diagram illustrating turbulence kinetic energy of a centrifugal fan 1 according to various embodiments. FIG. 13D is a diagram illustrating turbulence kinetic energy of a centrifugal fan 2 according to various embodiments.

Referring to FIGS. 13C and 13D, turbulence kinetic energy of a region A1 between a bell mouse 53 and a shroud 10 of the centrifugal fan 2 may be less than turbulence kinetic energy of a region A1 between a bell mouse 53 and a shroud 10 of the centrifugal fan 1. In addition, turbulence kinetic energy of an inner region A2 of the centrifugal fan 2 may be smaller than turbulence kinetic energy of an inner region A2 of the centrifugal fan 1. In addition, turbulence kinetic energy of a region A3 around a discharge hole of the centrifugal fan 2 may be less than turbulence kinetic energy of a region A3 around a discharge hole of the centrifugal fan 1. Accordingly, the centrifugal fan 2 may reduce noise generated by turbulence flow and efficiency loss due to turbulence flow compared to the centrifugal fan 1. That is, the centrifugal fan 2 may have lower noise and higher efficiency than the centrifugal fan 1.

Figure 13E:
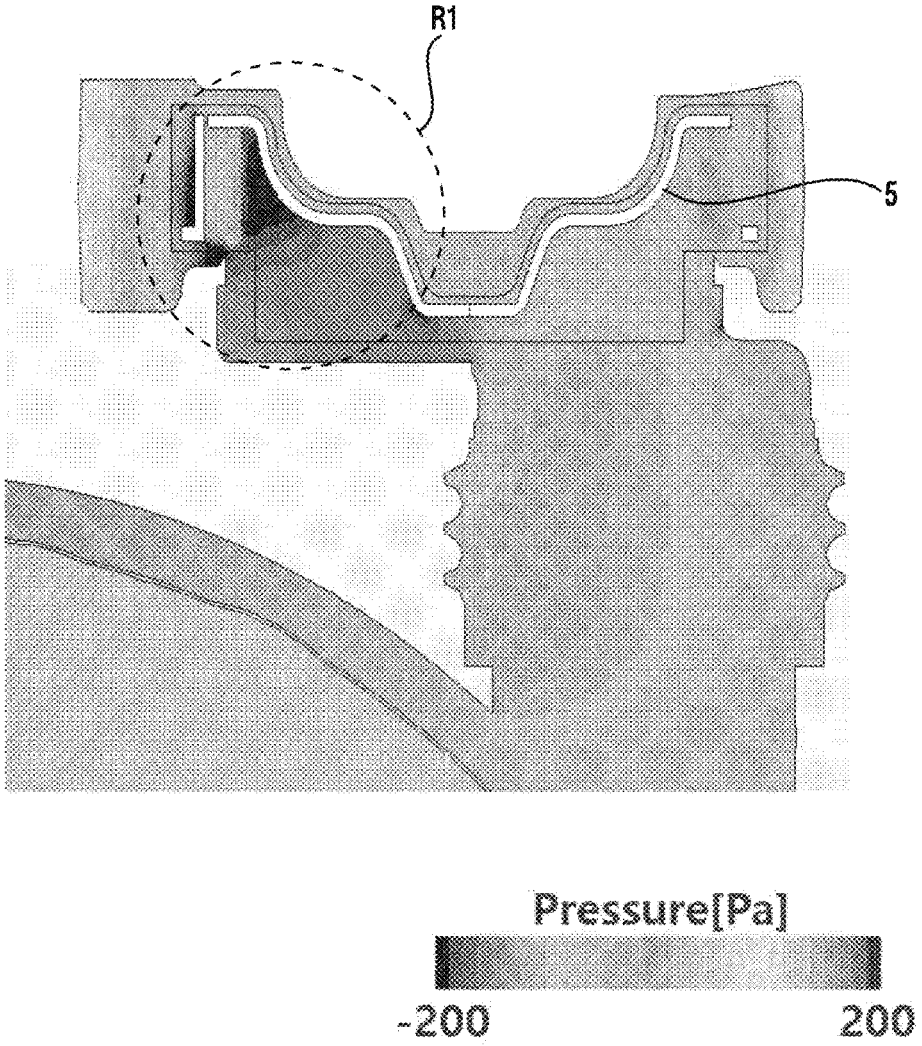
FIG. 13E is a diagram illustrating pressure distribution of a centrifugal fan according to a comparative example.
Figure 13F:
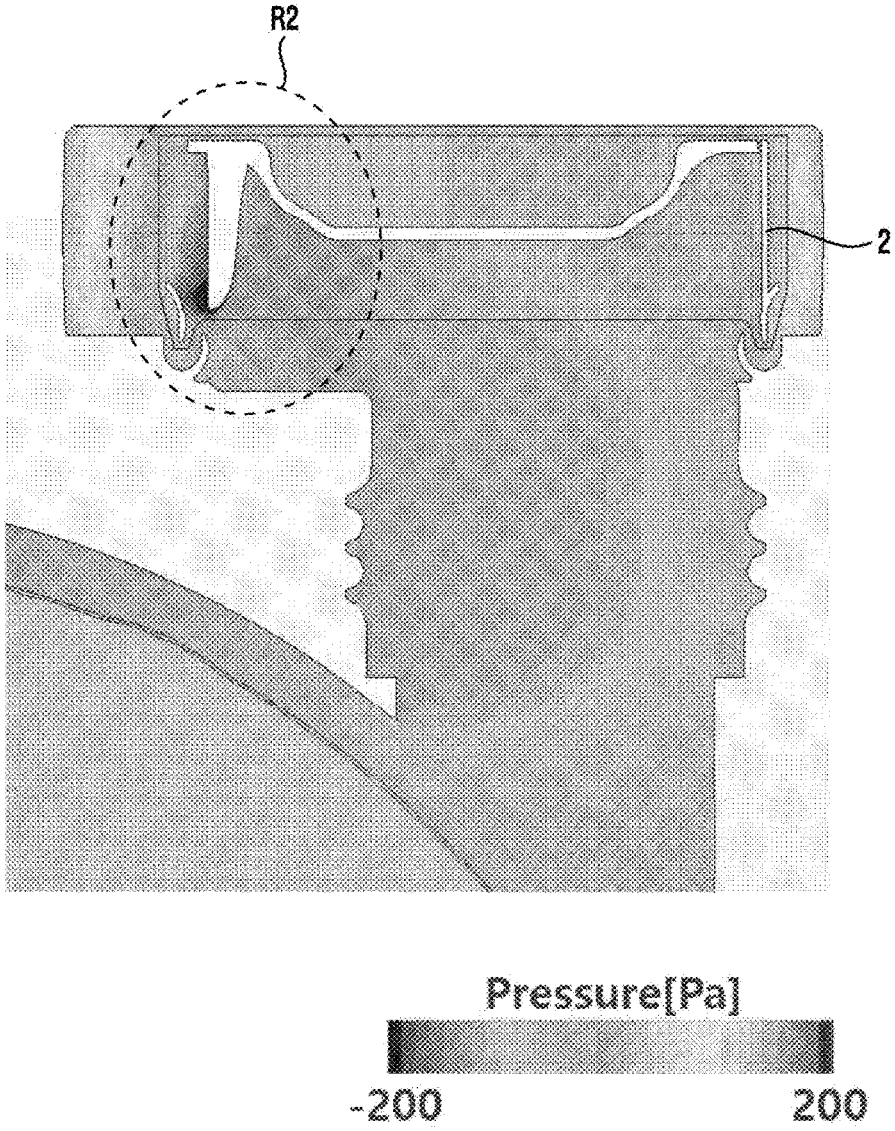
FIG. 13F is a diagram illustrating pressure distribution of a centrifugal fan according to various embodiments.

FIG. 13E is a diagram illustrating pressure distribution of a centrifugal fan according to a comparative example. FIG. 13F is a diagram illustrating pressure distribution of a centrifugal fan according to various embodiments.

Referring to FIGS. 13E and 13F, a pressure deviation in a region R2 between a front end and a rear end of the centrifugal fan 2 according to various embodiments may be smaller than a pressure deviation in a region R1 between a front end and a rear end of the centrifugal fan 5 in the comparative example. A smaller pressure deviation may result in lower noise and higher efficiency of the centrifugal fan. For example, the centrifugal fan 2 may have lower noise and higher efficiency than the centrifugal fan 5 of the comparative example.

Figure 14:
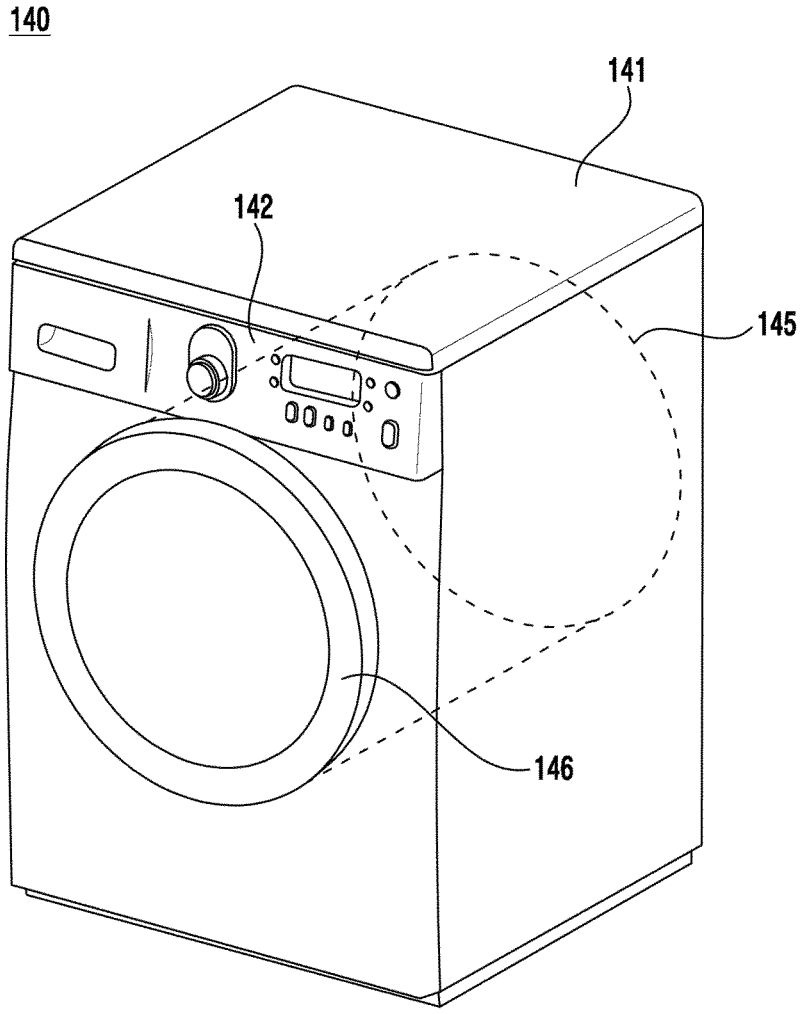
FIG. 14 is a perspective view illustrating a dryer according to various embodiments.

FIG. 14 is a perspective view illustrating a dryer according to various embodiments. A dryer 140 illustrated in FIG. 14 may be an example of a home appliance including the above-described centrifugal fans 1, 2, and 4. As another example, a home appliance including the above-described centrifugal fans 1, 2, and 4 may include an air conditioner, a laundry dryer, an air purifier, a range hood, a refrigerator, a dishwasher, a heater, a fan, a humidifier, a dehumidifier, a vacuum cleaner, or a hair dryer, but the disclosure is not limited thereto.

Referring to FIG. 14, the dryer 140 according to various embodiments may include a cabinet 141 accommodating components, a drum 145 rotatably installed in the cabinet 141, and a door 146 rotatably installed in the front of the cabinet 141. The front of the drum 145 may be opened, and a laundry as a target to be dried may be accommodated inside the drum 145 through the opened front of the drum 145. The opened front of the drum 145 may be opened or closed by the door 146.

The dryer 140 may include a control unit 142 provided on the front of the cabinet 141 and on the upper side of the door 146. The control unit 142 may include a display for guiding a user's input or displaying a screen for notifying an operation state of the dryer 140 and buttons for receiving the user's input. The buttons may be provided in a form of a jog shuttle, a dial, and/or a touch button integrated into the display or separately equipped.

Figure 15:
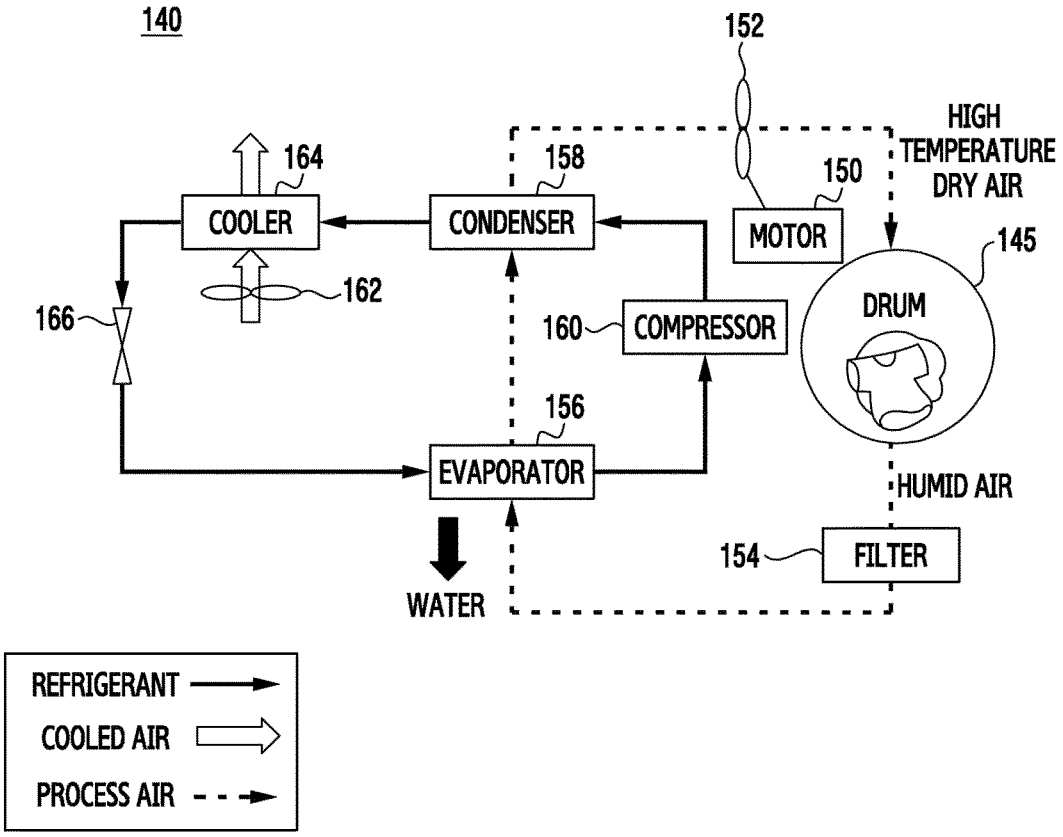
FIG. 15 is a diagram illustrating components in an example configuration of a dryer according to various embodiments.

FIG. 15 is a diagram illustrating components and an example configuration of a dryer according to various embodiments. A fan 152 illustrated in FIG. 15 may be an example of the above-described centrifugal fans 1, 2, or 4. A fan 162 illustrated in FIG. 15 may be an example of the above-described centrifugal fans 1, 2, or 4.

Referring to FIG. 15, a dryer 140 according to an embodiment may include a motor 150, a fan 152, a filter 154, an evaporator 156, a condenser 158, a compressor 160, a fan 162, a cooler 164, and an expander 166, which are disposed within the inside (e.g., the cabinet 141) of the dryer 140.

A drum 145 and the fan 152 may be rotated by the motor 150. For example, the motor 150 may provide rotation of the fan 152 through its shaft (e.g., the shaft 60 of FIG. 9), and may provide rotation of the drum 145 through a pulley and a belt. Alternatively, the fan 152 may be rotated by the motor 150, and the drum 145 may be rotated by a motor provided separately from the motor 150.

A heat pump system of the dryer 140 may be configured by the evaporator 156, the compressor 160, the condenser 158, and the expander 166. The refrigerant may circulate in the order of the evaporator 156, the compressor 160, the condenser 158, and the expander 166.

For example, the compressor 160 may compress a refrigerant in a gas state to a high temperature and high pressure state, and discharge the gaseous refrigerant of high temperature and high pressure. The discharged refrigerant may be transferred to the condenser 158.

The condenser 158 may condense the compressed gaseous refrigerant into a liquid. The condenser 158 may discharge heat to the surroundings through a condensation process of the refrigerant. The process air passing through the condenser 158 may be heated by the heat discharged to the surroundings of the condenser 158. The liquid refrigerant condensed in the condenser 158 may be transferred to the expander 166.

The expander 166 may expand the high-temperature and high-pressure liquid refrigerant condensed in the condenser 158 into a liquid refrigerant in a low-pressure state. For example, the expander 166 may include an electronic expansion valve whose opening and closing amount may be varied by capillary tubes and electric signals to control the pressure of liquid refrigerant.

The evaporator 156 may evaporate the liquid refrigerant expanded in the expander 166. The low-temperature and low-pressure gaseous refrigerant evaporated in the evaporator 156 may be transferred to the compressor 160. The evaporator 156 may absorb heat from the surroundings through an evaporation process of changing a low-pressure liquid refrigerant into a gaseous refrigerant. Accordingly, the process air passing through the evaporator 156 may be cooled.

When the surrounding air is cooled by the evaporator 156, and a temperature of the surrounding air lowers than a dew point, the surrounding air of the evaporator 156 may be condensed. The water condensed in the evaporator 156 may fall by gravity and be accommodated by a drip tray (not illustrated) equipped in the lower portion of the evaporator 156. Through a separate drain pump (not shown), the water collected in the drip tray may be delivered to a separate drip tray (e.g., a drip tray located in the upper portion of the dryer 140), or may be discharged to the outside.

In this way, the absolute humidity of the process air passing through the evaporator 156 may be lowered due to condensation occurring around the evaporator 156. That is, the amount of water vapor included in the process air passing through the evaporator 156 may be reduced. Using condensation around the evaporator 156, the dryer 140 may reduce the amount of water vapor included in the process air by passing through the drum 145, and may also dry the target to be dried.

The process air may be circulated between ducts, which are equipped inside the drum 145 and the dryer 140 and connected to the front and rear surfaces of the drum 145, by the fan 152. The fan 152 for circulating the process air, the evaporator 156 and the condenser 158 for heat exchange with the process air may be disposed inside the duct.

The process air sucked from the drum 145 may be dried (water vapor is condensed) by the evaporator 156 while passing through the evaporator 156. The process air passing through the evaporator 156 may move toward the condenser 158. The process air passing through the evaporator 156 may be heated by the condenser 158 while passing through the condenser 158, and the relative humidity of the process air may be lowered. That is, the amount of water vapor that the process air heated by the condenser 158 can accommodate may increase.

The process air heated by the condenser 158 may be introduced inside the drum 145 through an introduction hole (not illustrated) formed on the rear surface of the drum 145 and may absorb moisture from the target to be dried inside the drum 145. The process air absorbing moisture may move to the evaporator 156 by the fan 152. In this way, while circulating between the drum 145 and the duct, the process air may repeat cooling, dehumidification, heating, and moisture absorption.

The cooler 164 may form a flow path connecting the inside and the outside of the cabinet 141. The fan 162 may discharge high-temperature air inside the cabinet 141 to the outside of the cabinet 141 through the cooler 164. Accordingly, the inside of the cabinet 141 may be cooled and moisture inside the cabinet 141 may be removed.

A centrifugal fan (e.g., the centrifugal fan 2) according to an example embodiment may include: a plurality of blades (e.g., the plurality of blades 30) arranged about a rotation axis (e.g., the rotation axis A) of the centrifugal fan, and a first shroud (e.g., the first shroud 21) and a second shroud (e.g., the second shroud 22) located at ends of the plurality of blades. The second shroud may surround the first shroud and be spaced apart from the first shroud. The second shroud may not overlap the first shroud in a direction parallel to the rotation axis of the centrifugal fan. Accordingly, noise of the centrifugal fan may be reduced, and efficiency may be improved. In addition, top and bottom separation of a mold for injection molding of the centrifugal fan may be possible.

In an example embodiment, the first shroud and the second shroud may be separated by a first gap (e.g., the gap g1). One (e.g., the first blade 31) of the plurality of blades may be separated from another neighboring blade (e.g., the second blade 32) by a second gap (e.g., the gap g2). The first gap may be connected to the second gap.

In an example embodiment, the first shroud and the second shroud may be configured to provide a reintroduction path (e.g., the path P4) of air discharged in the centrifugal fan.

In an example embodiment, the first shroud and the second shroud may not include undercuts to enable top and bottom removal of a mold for injection molding of the centrifugal fan.

In an example embodiment, when viewed in a direction parallel to the rotation axis, a distance between the first shroud and the second shroud may be greater than or equal to 0.5 mm and less than or equal to 2.5 mm.

In an example embodiment, a flow inlet angle of the plurality of blades may be greater than or equal to 95 degrees and less than or equal to 105 degrees.

In an example embodiment, a flow exit angle of the plurality of blades may be greater than or equal to 140 degrees and less than or equal to 150 degrees.

In an example embodiment, a ratio of a height of a maximum bending point of the plurality of blades to a chord length of the plurality of blades may be greater than or equal to 0.17 and less than or equal to 0.2.

In an example embodiment, a ratio of an inner diameter of the plurality of blades to the chord length of the plurality of blades may be greater than or equal to 2.5 and less than or equal to 3.0.

According to an example embodiment, the centrifugal fan may include: a hub plate on which the plurality of blades are disposed on a side, a plurality of other blades (e.g., the plurality of blades 35) disposed on another surface of the hub plate (e.g., the hub plate 45) and arranged about the rotation axis, and a third shroud and a fourth shroud located at ends of the plurality of other blades. The fourth shroud may surround the third shroud and be spaced apart from the third shroud. The fourth shroud may not overlap the third shroud in a direction parallel to the rotation axis of the centrifugal fan.

According to an example embodiment, a home appliance (e.g., the dryer 140) may include: a centrifugal fan. The centrifugal fan may include: a plurality of blades arranged about a rotation axis of the centrifugal fan, and a first shroud and a second shroud located at ends of the plurality of blades. The second shroud may surround the first shroud and be spaced apart from the first shroud. The second shroud may not overlap the first shroud in a direction parallel to the rotation axis of the centrifugal fan. Accordingly, noise of the home appliance due to an operation of the centrifugal fan may be reduced, and the efficiency of the home appliance may be improved.

In an example embodiment, the first shroud and the second shroud may be separated by a first gap (e.g., the gap g1). One (e.g., the first blade 31) of the plurality of blades may be separated from another neighboring blade (e.g., the second blade 32) by a second gap (e.g., the gap g2). The first gap may be connected to the second gap.

In an example embodiment, the first shroud and the second shroud may be configured to provide a reintroduction path (e.g., the path P4) of air discharged in the centrifugal fan.

In an example embodiment, the first shroud and the second shroud may not include undercuts to enable top and bottom removal of a mold for injection molding of the centrifugal fan.

In an example embodiment, when viewed in a direction parallel to the rotation axis, a distance between the first shroud and the second shroud may be greater than or equal to 0.5 mm and less than or equal to 2.5 mm.

In an example embodiment, a flow inlet angle of the plurality of blades may be greater than or equal to 95 degrees and less than or equal to 105 degrees, and a flow exit angle of the plurality of blades may be greater than or equal to 140 degrees and less than or equal to 150 degrees.

In an example embodiment, a ratio of a height of a maximum bending point of the plurality of blades to a chord length of the plurality of blades may be greater than or equal to 0.17 and less than or equal to 0.2.

In an example embodiment, a ratio of an inner diameter of the plurality of blades to the chord length of the plurality of blades may be greater than or equal to 2.5 and less than or equal to 3.0.

In an example embodiment, the centrifugal fan may include: a hub plate on which the plurality of blades are disposed on a side, a plurality of other blades (e.g., the plurality of blades 35) disposed on another surface of the hub plate (e.g., the hub plate 45) and arranged about the rotation axis, and a third shroud and a fourth shroud located at ends of the plurality of other blades. The fourth shroud may surround the third shroud and be spaced apart from the third shroud. The fourth shroud may not overlap the third shroud in a direction parallel to the rotation axis of the centrifugal fan.

In an example embodiment, the home application may include a dryer, a laundry dryer, an air conditioner, a range hood, or an air purifier.

The electronic device according to various embodiments may be one of various types of electronic devices. The electronic devices may include, for example, a portable communication device (e.g., a smartphone), a computer device, a portable multimedia device, a portable medical device, a camera, a wearable device, a home appliance, or the like. According to an embodiment of the disclosure, the electronic devices are not limited to those described above.

It should be appreciated that various embodiments of the present disclosure and the terms used therein are not intended to limit the technological features set forth herein to particular embodiments and include various changes, equivalents, or replacements for a corresponding embodiment. With regard to the description of the drawings, similar reference numerals may be used to refer to similar or related elements. It is to be understood that a singular form of a noun corresponding to an item may include one or more of the things unless the relevant context clearly indicates otherwise. As used herein, each of such phrases as "A or B," "at least one of A and B," "at least one of A or B," "A, B, or C," "at least one of A, B, and C," and "at least one of A, B, or C," may include any one of or all possible combinations of the items enumerated together in a corresponding one of the phrases. As used herein, such terms as "1st" and "2nd," or "first" and "second" may be used to simply distinguish a corresponding component from another, and does not limit the components in other aspect (e.g., importance or order). It is to be understood that if an element (e.g., a first element) is referred to, with or without the term "operatively" or "communicatively", as "coupled with," or "connected with" another element (e.g., a second element), the element may be coupled with the other element directly (e.g., wiredly), wirelessly, or via a third element.

While the disclosure has been illustrated and described with reference to various example embodiments, it will be understood that the various example embodiments are intended to be illustrative, not limiting. It will be further understood by those skilled in the art that various changes in form and detail may be made without departing from the true spirit and full scope of the disclosure, including the appended claims and their equivalents. It will also be understood that any of the embodiment(s) described herein may be used in conjunction with any other embodiment(s) described herein.

What is claimed is:

1. A centrifugal fan comprising:

a plurality of blades arranged about a rotation axis of the centrifugal fan; and a first shroud and a second shroud located at ends of the plurality of blades, wherein the second shroud is adjacent to the first shroud and surrounds the first shroud, wherein the second shroud does not overlap the first shroud in a direction parallel to the rotation axis of the centrifugal fan, wherein, in a plan view, an inner edge of the second shroud is spaced radially outward from an outer edge of the first shroud, and wherein an inner diameter of the inner edge of the second shroud is larger than an outer diameter of the outer edge of the first shroud such that a radial gap is formed between the first shroud and the second shroud.

2. The centrifugal fan of claim 1, wherein:

in a plan view, the first shroud and the second shroud are separated by a first gap;

one of the plurality of blades is separated from another neighboring blade by a second gap; and the first gap is connected to the second gap such that air passing through the first gap flows directly into the second gap.

3. The centrifugal fan of claim 1, wherein the first shroud and the second shroud are configured to provide a reintroduction path for air discharged from the centrifugal fan.

4. The centrifugal fan of claim 1, wherein the first shroud and the second shroud do not include undercuts to enable top and bottom separation of a mold for injection molding of the centrifugal fan.

5. The centrifugal fan of claim 1, wherein, when viewed in a direction parallel to the rotation axis, a distance between the first shroud and the second shroud is greater than 0, and less than or equal to 2% of an outer diameter of the centrifugal fan.

6. The centrifugal fan of claim 1, wherein a flow inlet angle of each of the plurality of blades is 95 degrees or more and 105 degrees or less, the flow inlet angle being defined as an angle between a direction of fluid inflow at a leading edge of the blade and a chord line connecting a center of the leading edge and a center of a trailing edge of the blade.

7. The centrifugal fan of claim 1, wherein a flow exit angle of each of the plurality of blades is 140 degrees or more and 150 degrees or less, the flow exit angle being defined as an angle between a direction of fluid outflow at a trailing edge of the blade and a chord line connecting a center of the leading edge and a center of a trailing edge of the blade.

8. The centrifugal fan of claim 1, wherein a ratio of a height of a maximum bending point of the plurality of blades to a chord length of the plurality of blades is 0.17 or more and 0.2 or less.

9. The centrifugal fan of claim 1, wherein a ratio of an inner diameter of the plurality of blades to a chord length of the plurality of blades is 2.5 or more and 3.0 or less.

10. The centrifugal fan of claim 1, comprising:

a hub plate on which the plurality of blades are disposed on a side;

a plurality of other blades disposed on another side of the hub plate and arranged about the rotation axis; and a third shroud and a fourth shroud located at ends of the plurality of another blades, and wherein:

the fourth shroud surrounds the third shroud and is spaced apart from the third shroud; and the fourth shroud does not overlap the third shroud in the direction parallel to the rotation axis of the centrifugal fan.

11. A home appliance comprising a centrifugal fan including:

a plurality of blades arranged about a rotation axis of the centrifugal fan; and a first shroud and a second shroud located at ends of the plurality of blades, wherein the second shroud is adjacent to the first shroud and surrounds the first shroud, wherein the second shroud does not overlap the first shroud in a direction parallel to the rotation axis of the centrifugal fan, wherein, in a plan view, an inner edge of the second shroud is spaced radially outward from an outer edge of the first shroud, and wherein an inner diameter of the inner edge of the second shroud is larger than an outer diameter of the outer edge of the first shroud such that a radial gap is formed between the first shroud and the second shroud.

12. The home appliance of claim 11, wherein:

in a plan view, the first shroud and the second shroud are separated by a first gap;

one of the plurality of blades is separated from another neighboring blade by a second gap; and the first gap is connected to the second gap such that air passing through the first gap flows directly into the second gap.

13. The home appliance of claim 11, wherein the first shroud and the second shroud are configured to provide a reintroduction path for air discharged from the centrifugal fan.

14. The home appliance of claim 11, wherein the first shroud and the second shroud do not include undercuts to enable top and bottom separation of a mold for injection molding of the centrifugal fan.

15. The home appliance of claim 11, wherein, when viewed in a direction parallel to the rotation axis, a distance between the first shroud and the second shroud is 2.5 mm or less.

16. The home appliance of claim 11, wherein:

a flow inlet angle of each of the plurality of blades is 95 degrees or more and 105 degrees or less, the flow inlet angle being defined as an angle between a direction of fluid inflow at a leading edge of the blade and a chord line connecting a center of the leading edge and a center of a trailing edge of the blade; and a flow exit angle of each of the plurality of blades is 140 degrees or more and 150 degrees or less, the flow exit angle being defined as an angle between a direction of fluid outflow at a trailing edge of the blade and a chord line connecting a center of the leading edge and a center of a trailing edge of the blade.

17. The home appliance of claim 11, wherein a ratio of a height of a maximum bending point of the plurality of blades to a chord length of the plurality of blades is 0.17 or more and 0.2 or less.

18. The home appliance of claim 11, wherein a ratio of an inner diameter of the plurality of blades to a chord length of the plurality of blades is 2.5 or more and 3.0 or less.

19. The home appliance of claim 11, wherein the centrifugal fan includes: a hub plate on which the plurality of blades are disposed on a side;

a plurality of other blades disposed on another side of the hub plate and arranged around the rotation axis; and a third shroud and a fourth shroud located at ends of the plurality of another blades, and wherein:

the fourth shroud surrounds the third shroud and is spaced apart from the third shroud; and the fourth shroud does not overlap the third shroud in the direction parallel to the rotation axis of the centrifugal fan.

20. The home appliance of claim 11, comprising:

a dryer, a laundry dryer, an air conditioner, a range hood, or an air purifier.

* * * * *